US011653812B2

(12) United States Patent
Suda et al.

(10) Patent No.: US 11,653,812 B2
(45) Date of Patent: May 23, 2023

(54) CLEANING TOOL

(71) Applicant: UNICHARM CORPORATION, Ehime (JP)

(72) Inventors: Tomokazu Suda, Kagawa (JP); Yasuhiko Kenmochi, Kagawa (JP); Yuuka Manabe, Kagawa (JP); Ayuka Yamamichi, Kagawa (JP)

(73) Assignee: UNICHARM CORPORATION, Ehime (JP)

( * ) Notice: Subject to any disclaimer, the term of this patent is extended or adjusted under 35 U.S.C. 154(b) by 427 days.

(21) Appl. No.: 16/982,044

(22) PCT Filed: Dec. 20, 2018

(86) PCT No.: PCT/JP2018/047122
§ 371 (c)(1),
(2) Date: Sep. 18, 2020

(87) PCT Pub. No.: WO2019/181121
PCT Pub. Date: Sep. 26, 2019

(65) Prior Publication Data

US 2021/0015334 A1 Jan. 21, 2021

(30) Foreign Application Priority Data

Mar. 20, 2018 (JP) ..... JP2018-053542

(51) Int. Cl.
*A47L 13/42* (2006.01)
*A47L 13/24* (2006.01)
*A47L 13/38* (2006.01)

(52) U.S. Cl.
CPC ..... *A47L 13/42* (2013.01); *A47L 13/24* (2013.01); *A47L 13/38* (2013.01)

(58) Field of Classification Search
CPC ... A46B 5/0058; A46B 5/0075; A46B 5/0083; A47L 13/24; A47L 13/38; A47L 13/42;
(Continued)

(56) References Cited

U.S. PATENT DOCUMENTS 6,286,968 B1 * 9/2001 Sailer ..... B60R 1/0617 248/478
2005/0102781 A1 5/2005 Tsuchiya et al.
(Continued)

FOREIGN PATENT DOCUMENTS

JP 200178942 A 3/2001
JP 2001078942 A * 3/2001
(Continued)

OTHER PUBLICATIONS

English Translation of JP 2001078942 A (Year: 2001).*
(Continued)

*Primary Examiner* — Anne M Kozak
*Assistant Examiner* — Ian James Geiger
(74) *Attorney, Agent, or Firm* — Hauptman Ham, LLP

(57) ABSTRACT

A cleaning tool has a rotating section including: the pressing section including a rotation-control protrusion; a first coupling section; and a second coupling section. The second coupling section includes a plurality of rotation-control recessions that include: a base section that receives a sliding section; and a rotation-control wall section that fixes the arm angle by mating with a side surface section. The second coupling section also includes release-direction inclined sections whereby, in the housed state, the rotation-control protrusion can be moved from a first rotation-control recession to a second rotation-control recession, by the second coupling section sliding the sliding section to the first rotation-control wall section mated with the rotation-control protrusion, without pressing the pressing section.

14 Claims, 13 Drawing Sheets

(58) Field of Classification Search
CPC ... B25G 1/06; B25G 3/14; B25G 3/18; B25G 3/38; Y10T 16/476; Y10T 16/498; Y10T 16/532; Y10T 16/5323; Y10T 16/54; Y10T 16/5404; Y10T 16/54044
USPC ..... 15/104.1, 144.1
See application file for complete search history.

(56) References Cited

U.S. PATENT DOCUMENTS

| | | | | |
|---|---|---|---|---|
| 2007/0214607 | A1* | 9/2007 | Lin | B25G 3/38 16/438 |
| 2012/0117743 | A1 | 5/2012 | Yang et al. | |
| 2018/0228340 | A1 | 8/2018 | Suda | |

FOREIGN PATENT DOCUMENTS

| | | | | |
|---|---|---|---|---|
| JP | 2001218719 | A | | 8/2001 |
| JP | 200449619 | A | | 2/2004 |
| JP | 2014168646 | A | | 9/2014 |
| JP | 2017136130 | A | * | 8/2017 |
| JP | 2017136130 | A | | 8/2017 |

OTHER PUBLICATIONS

English Translation of JP 2017136130 A (Year: 2017).*
International Search Report in PCT Application No. PCT/JP2018/047122, dated Mar. 26, 2019, 4pp.

* cited by examiner

CLEANING TOOL

RELATED APPLICATIONS

The present application is a National Phase of International Application No. PCT/JP2018/047122, filed Dec. 20, 2018, and claims priority based on Japanese Patent Application No. 2018-053542, filed Mar. 20, 2018.

FIELD

The present disclosure relates to a cleaning tool.

BACKGROUND

A cleaning tool in which a disposable cleaning body is attached to a cleaning body attachment portion, whereby performs wipe cleaning of dust, etc., is commercially available. For example, in Patent Literature 1, a small angle adjustable cleaning tool with excellent operability is described, which can perform wipe and sweep cleaning for either a plane surface portion such as a wall or a ceiling, or a fine portion such as a surface or an upper surface of furniture or a surface of an ornament, easily with one hand by adjusting and fixing the handle to the required angle, and can perform the angle adjusting operation extremely easily.

The angle adjustable cleaning tool described in Patent Literature 1 has the following configurations.

The angle adjustable cleaning tool is the one which includes a short columnar grip member which has a length such that both ends slightly protrudes from a palm in a gripped state, an attachment member for wipe and sweep material which is connected to a tip end of the grip member through a connection mechanism so that an angle is adjustable, and a wipe and sweep material which is attached to the attachment member in a freely detachable manner, characterized in that the attachment member is configured by a short first portion which is positioned on a base end portion side, a long second portion which is continuous in a state bent at a tip end of the first portion, and a wipe and sweep material attachment portion which is formed in the second portion, wherein the connection mechanism includes a manipulator so as to operate a switching between a state in which the attachment member is rotatable and a state in which the attachment member is fixed to a specific angle, and the manipulator is provided at a position which is operable with a thumb in a state in which the grip member is gripped by one hand.

CITATION LIST

Patent Literature

[PTL 1] Japanese Unexamined Patent Publication No. 2001-78942

SUMMARY

Technical Problem

The angle adjustable cleaning tool described in Patent Literature 1 has a mechanism so as to operate the switching between a state in which the attachment member 5 is rotatable and the attachment member 5 is fixed to a specific angle, by pushing the connection shaft 13 in the axis line direction of the connection shaft 13 from the positions of the connection portion for rotation 11 of the attachment member 5, and the first connection portion for supporting 10a and the second connection portion for supporting 10b of the grip member 4. In other words, the angle adjustable cleaning tool described in Patent Literature 1 cannot put the attachment member 5 in a rotatable state unless the connection shaft 13 is moved. Accordingly, there may be cases in which the user of the angle adjustable cleaning tool described in Patent Literature 1 does not notice pushing the connection shaft 13 for making the attachment member 5 in a rotatable state, and rotates the attachment member 5 without pushing the connection shaft 13, whereby damages the angle adjustable cleaning tool.

Accordingly, the object of the present disclosure is to provide a cleaning tool which is capable of changing the arm angle of the cleaning tool in a stored state up to a predetermined angle without pushing the pushing portion, and is capable of changing the arm angle beyond the predetermined angle by pushing the pushing portion.

Solution to Problem

The present inventors found out that a cleaning tool comprising a first arm portion, a second arm portion, a rotation portion, and a cleaning body attachment portion which is connected to the second arm portion, the cleaning tool being capable of taking a stored state, wherein the rotation portion includes a rotation axis line, a rotation direction which includes an opening direction, and a depth direction along the rotation axis line, the rotation portion includes a pushing portion, two or more first connection portions which are connected to one of the first arm portion and the second arm portion, each of the first connection portions including a first shaft hole, and a second connection portion which is connected to the other of the first arm portion and the second arm portion and includes a second shaft hole, the pushing portion includes a protrusion for rotation control which fixes an arm angle of the first arm portion and the second arm portion, and penetrates the first shaft holes and the second shaft hole, the protrusion for rotation control includes a side surface portion which protrudes toward a direction orthogonal to the rotation axis line and extends in a direction of the rotation axis line, and a sliding portion which is arranged at an end portion on a deeper side in the depth direction, the second connection portion includes a plurality of hollows for rotation control which are arranged along the rotation direction, each of which including a base portion which is configured so as to receive the sliding portion of the protrusion for rotation control, and a wall portion for rotation control which fixes the arm angle by fitting with the side surface portion of the protrusion for rotation control, the rotation portion is configured so that a fitting of the side surface portion of the protrusion for rotation control and the wall portion for rotation control is released by pushing the pushing portion in the depth direction, and in the stored state, the second connection portion includes an opening direction inclination portion which makes the protrusion for rotation control move from a first hollow for rotation control which fits with the protrusion for rotation control among the plurality of hollows for rotation control to a second hollow for rotation control which is adjacent to the first hollow for rotation control in the opening direction, by making the sliding portion of the protrusion for rotation control slide, without pushing the pushing portion in a first wall portion for rotation control of the first hollow for rotation control is the solution to the problem.

Advantageous Effects of Invention

The cleaning tool of the present disclosure is capable of changing the arm angle of the cleaning tool in a stored state up to a predetermined angle without pushing the pushing portion, and is capable of changing the arm angle beyond the predetermined angle by pushing the pushing portion.

DESCRIPTION OF EMBODIMENTS

Definitions

Figure 1:
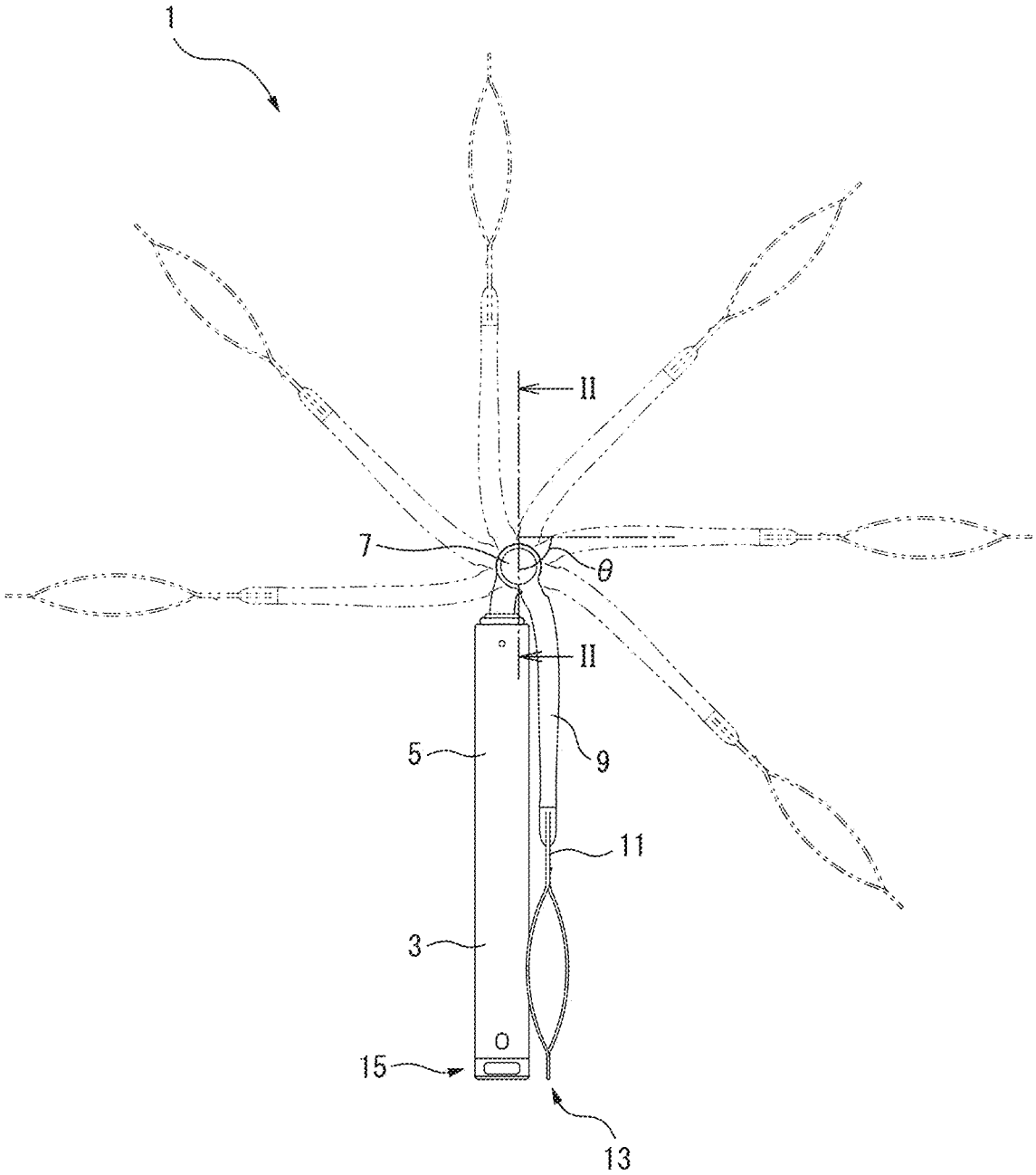
FIG. 1 is a side surface view of the cleaning tool 1 in the stored state.

"the stored state" and "the cleaning state" in relation to a cleaning tool

In the present description, "the stored state" in relation to a cleaning tool means the state which is adopted when storing the cleaning tool. Generally, a cleaning tool in the stored state is in a state in which the extendable portions of the cleaning tool are entirely shrunk (to be in the stored state), and the arm angle is made to be the minimum.

In the present description, "the cleaning state" in relation to a cleaning tool means the state which is adopted when using the cleaning tool. Generally, a cleaning tool in the cleaning state is in a state in which the arm angle is changed in accordance with the portion to be cleaned, and the extendable portions of the cleaning tool are extended in accordance with the portion to be cleaned (in a case of an extendable and shrinkable member, such a state includes the extension state). Incidentally, in a case in which a portion close to the user is to be cleaned, the cleaning tool may be used without extending the extendable portions of the cleaning tool.

"the arm angle" in relation to a cleaning tool (the rotation portion)

In the present description, "the arm angle" in relation to a cleaning tool (the rotation portion) means the angle between the first arm portion axis line of the first arm portion and the second arm portion axis line of the second arm portion.

"the base end" and "the tip end"

In the present description, "the base end" and "the tip end" mean the edge on the first arm portion side of the cleaning tool, and the edge on the cleaning body attachment portion side thereof, respectively.

"the inner side" and "the outer side"

In the present description, "the inner side" and "the outer side" mean in an object which has an axis line, the direction which becomes closer to the axis line, and the direction which becomes farther to the axis line, respectively. Incidentally, each of the inner side and the outer side may be a direction which is orthogonal to the axis line, and may be a direction which crosses the axis line.

"the outer surface cross sectional shape" and "the inner surface cross sectional shape"

In the present description, "the outer surface cross sectional shape" is a term which is used for an object that has an axis line and an outer shape, and "the outer surface cross sectional shape" means a shape of a portion in which a planer surface orthogonal to the axis line and the outer shape of the object cross with each other. Incidentally, the above-mentioned outer surface cross sectional shape is also used for a case in which the object is a void, for example, a hollow portion, etc.

In the present description, "the inner surface cross sectional shape" is a term which is used for an object that has an axis line and an inner shape (a void), and "the inner surface cross sectional shape" means a shape of a portion in which a planer surface orthogonal to the axis line and the inner shape of the object cross with each other.

"the depth direction" and "the depth position" in relation to the configurational member of the rotation portion In the present description, in relation to the configurational member of the rotation portion, the direction from the top portion of the pushing portion toward the bottom portion among the direction of the rotation axis line of the rotation portion is referred to as "the depth direction". Further, in relation to the configurational member of the rotation portion, in a case in which one is present on the top portion side and the other is present on the bottom portion side, the one is referred to as being arranged at a shallower depth position than the other, and the other is referred to as being arranged at a deeper depth position than the one.

"the initial depth position", "the switch depth position" and "the maximum depth position" of the pushing portion, and "the unrotatable state" and "the rotatable state" in relation to the rotation portion In the present description, the shallowest depth position of the top portion in a case in which the pushing portion is not in a state of being pushed in the depth direction is referred to as "the initial depth position" of the pushing portion, and the shallowest depth position of the top portion in a case in which the pushing portion is in a state of being pushed in the depth direction in the maximum degree is referred to as "the maximum depth position" of the pushing portion. Further, the shallowest depth position of the top portion when the rotation portion is switched from the unrotatable state to the rotatable state is referred to as "the switch depth position" of the pushing portion. The switch depth position and the maximum depth position may be the same depth position.

The initial depth position: $D_0$ (=0), the switch depth position: $D_C$ and the maximum depth position: $D_{MAX}$ of the pushing portion are in the following relationship.

$$D_0<D_C\leq D_{MAX}$$

Further, in a case in which the depth position: $D_X$ of the pushing portion satisfies the relationship of $D_0\leq D_X<D_C$, the rotation portion is in the unrotatable state, and in a case in which the same satisfies the relationship of $D_C\leq D_X\leq D_{MAX}$, the rotation portion is in the rotatable state.

The present disclosure relates to the following aspects.

[Aspect 1]

A cleaning tool comprising a first arm portion, a second arm portion, a rotation portion, and a cleaning body attachment portion which is connected to the second arm portion, the cleaning tool being capable of taking a stored state, wherein the rotation portion includes a rotation axis line, a rotation direction which includes an opening direction, and a depth direction along the rotation axis line, the rotation portion includes a pushing portion, two or more first connection portions which are connected to one of the first arm portion and the second arm portion, each of the first connection portions including a first shaft hole, and a second connection portion which is connected to the other of the first arm portion and the second arm portion and includes a second shaft hole, the pushing portion includes a protrusion for rotation control which fixes an arm angle of the first arm portion and the second arm portion, and penetrates the first shaft holes and the second shaft hole, the protrusion for rotation control includes a side surface portion which protrudes toward a direction orthogonal to the rotation axis line and extends in a direction of the rotation axis line, and a sliding portion which is arranged at an end portion on a deeper side in the depth direction, the second connection portion includes a plurality of hollows for rotation control which are arranged along the rotation direction, each of which including a base portion which is configured so as to receive the sliding portion of the protrusion for rotation control, and a wall portion for rotation control which fixes the arm angle by fitting with the side surface portion of the protrusion for rotation control, the rotation portion is configured so that a fitting of the side surface portion of the protrusion for rotation control and the wall portion for rotation control is released by pushing the pushing portion in the depth direction, and in the stored state, the second connection portion includes an opening direction inclination portion which makes the protrusion for rotation control move from a first hollow for rotation control which fits with the protrusion for rotation control among the plurality of hollows for rotation control to a second hollow for rotation control which is adjacent to the first hollow for rotation control in the opening direction, by making the sliding portion of the protrusion for rotation control slide, without pushing the pushing portion in a first wall portion for rotation control of the first hollow for rotation control.

The above-mentioned cleaning tool includes the predetermined opening direction inclination portion, whereby can change the arm angle of the cleaning tool in the stored state up to the predetermined angle (the angle between the first hollow for rotation control and the second hollow for rotation control) without pushing the pushing portion, and can change the arm angle beyond the predetermined angle by pushing the pushing portion.

Further, accordingly, the user can easily deform the cleaning tool in the stored state without pushing the pushing portion of the rotation portion until the arm angle reaches the predetermined angle. Still further, when the cleaning tool in the stored state is deformed until the arm angle reaches the predetermined angle, the reciprocating motion of the pushing portion, the contact sound between the sliding portion and the base portion, etc., occur, whereby can make the user notice that the user needs to push the pushing portion of the rotation portion in order to change the arm angle.

[Aspect 2]

The cleaning tool according to aspect 1, wherein the opening direction inclination portion is arranged at least at an end portion on an opening direction side of the first hollow for rotation control, and the opening direction inclination portion at the end portion is arranged, in the depth direction, at a depth position which is the same as a depth position of a first base portion of the first hollow for rotation control, or at a depth position which is shallower than the depth position of the first base portion.

In the above-mentioned cleaning tool, in the depth direction, the depth positions of the opening direction inclination portion and the first base portion satisfy the predetermined relationship, whereby the arm angle of the cleaning tool in the stored state can be easily changed up to the predetermined angle without pushing the pushing portion.

[Aspect 3]

The cleaning tool according to aspect 1 or 2, wherein the side surface portion of the protrusion for rotation control includes a distal portion which is farthest from the rotation axis line, the wall portion for rotation control includes a distal corresponding portion which corresponds to the distal portion, and the opening direction inclination portion is arranged between a first distal corresponding portion of the first wall portion for rotation control of the first hollow for rotation control and a second distal corresponding portion of a second wall portion for rotation control of the second hollow for rotation control.

In the above-mentioned cleaning tool, the opening direction inclination portion is arranged between the first distal corresponding portion and the second distal corresponding portion, whereby the arm angle of the cleaning tool in the stored state can be easily changed up to the predetermined angle without pushing the pushing portion.

[Aspect 4]

The cleaning tool according to aspect 3, wherein the opening direction inclination portion is arranged at the first distal corresponding portion, and the opening direction inclination portion at the first distal corresponding portion is arranged, in the depth direction, at a depth position which is the same as a depth position of a first base portion of the first hollow for rotation control, or at a depth position which is shallower than the depth position of the first base portion.

In the above-mentioned cleaning tool, in the depth direction, the depth positions of the opening direction inclination portion and the first base portion satisfy the predetermined relationship, whereby the arm angle of the cleaning tool in the stored state can be easily changed up to the predetermined angle without pushing the pushing portion.

[Aspect 5]

The cleaning tool according to any one of aspects 1 to 4, wherein the second connection portion includes five or more hollows for rotation control, and the plurality of hollows for rotation control are arranged with a predetermined interval along the rotation direction.

In the above-mentioned cleaning tool, the second connection portion includes five or more hollows for rotation control which are arranged at the predetermined angle, whereby it becomes difficult for a cleaning tool which is present at the predetermined position (the cleaning tool in which the protrusion for rotation control is arranged at the second hollow for rotation control) to return to the stored state. Accordingly, it is easy for the above-mentioned cleaning tool to clean the cleaning surface with high front and low back (especially a cleaning surface at high places), for example, an indirect lighting lamp shade which is opened upwards, etc.

[Aspect 6]

The cleaning tool according to any one of aspects 1 to 5, wherein a second wall portion for rotation control of the second hollow for rotation control includes a closing direction inclination portion which makes the protrusion for rotation control move from the second hollow for rotation control to the first hollow for rotation control, by making the sliding portion of the protrusion for rotation control slide, without pushing the pushing portion.

The above-mentioned cleaning tool includes the predetermined closing direction inclination portion, whereby the cleaning tool can be closed from the predetermined position (the position of the second hollow for rotation control) to the folded state without pushing the pushing portion. Accordingly, when the user folds the cleaning tool, it is not necessary to hold firmly the first arm portion and the second arm portion, and it is difficult to pinch a finger between the first arm portion and the second arm portion.

[Aspect 7]

The cleaning tool according to any one of aspects 1 to 6, wherein the pushing portion includes the plurality of protrusions for rotation control.

In the above-mentioned cleaning tool, the above-mentioned pushing portion includes the plurality of protrusions for rotation control, whereby even in a case in which the cleaning tool comes into contact with a portion to be cleaned, for example, walls, etc., during cleaning, and a force is applied to the rotation portion, it is difficult for the arm angle to be changed.

[Aspect 8]

The cleaning tool according to any one of aspects 1 to 7, wherein the pushing portion is configured by, in the direction of the rotation axis line, a top portion, a bottom portion, and a connection shaft which connects the top portion and the bottom portion, and the pushing portion is pushed, in the depth direction, from an initial depth position up to a switch depth position, the two or more first connection portions include a top portion side first connection portion which is arranged at a shallowest depth position and includes a top portion side grip portion, and a bottom portion side first connection portion which is arranged at a deepest depth position and includes a bottom portion side grip portion, and the bottom portion side grip portion is configured to be arranged, in the depth direction, at a depth position which is the same as a depth position of the bottom portion of the pushing portion which is arranged at the switch depth position, or at a depth position which is deeper than the depth position of the bottom portion.

In the above-mentioned cleaning tool, the number of the configurational members of the rotation portion is small, and the rotation portion has a simple structure.

Further, in the above-mentioned cleaning tool, the bottom portion side grip portion of the bottom portion side first connection portion is configured to be arranged, in the depth direction, at a depth position which is the same as a depth position of the bottom portion of the pushing portion which is arranged at the switch depth position, or at a depth position which is deeper than the depth position of the bottom portion (hereinbelow, which may be referred to as "the predetermined depth position"), whereby the user may hold the rotation portion from both ends in the rotation axis line and operate the pushing portion as if pushing the same, so that the user can easily switch the unrotatable state and the rotatable state of the rotation portion.

To be specific, the user can, for example, in a state of attaching the fingertip of the right thumb to the top portion of the pushing portion and the top portion side grip portion, and attaching the right index finger to the bottom portion side grip portion of the bottom portion side first connection portion, push the top portion of the pushing portion with the fingertip of the right thumb, push the pushing portion, so as to switch the rotation portion from the unrotatable state to the rotatable state. Since the bottom portion side grip portion is arranged at the predetermined depth position, it is difficult for the index finger to be pushed back by the bottom portion. Accordingly, the user can operate the pushing portion as if pushing the same.

Further, in the above-mentioned cleaning tool, the rotation portion can be directly held from the both ends in the direction of the rotation axis line of the rotation portion, whereby when switching the rotation portion to the rotatable state and making the same rotate, it is difficult for a force in the direction orthogonal to the axis line of the arm portion to be applied to the arm portion, that is, the first arm portion and the second arm portion, and for the arm portion to be damaged.

[Aspect 9]

The cleaning tool according to aspect 8, wherein the pushing portion is configured so as to rotate together with the top portion side first connection portion and the bottom portion side first connection portion when changing the arm angle.

In the above-mentioned cleaning tool, when changing the arm angle, the pushing portion, and the top portion side first connection portion and the bottom portion side first connection portion rotate in conjunction with each other. That is, when changing the arm angle, the top portion side portion and the bottom portion side portion of the rotation portion are to rotate in conjunction with each other. Accordingly, when the user pushes the pushing portion so as to change the arm angle, while holding the top portion side portion and the bottom portion side portion of the pushing portion, the finger of the user rotates together with the top portion side portion and the bottom portion side portion of the pushing portion, whereby it is difficult for the finger of the user to be pulled in conjunction by a member which does not rotate. Incidentally, in a case in which the pushing portion, and the top portion side first connection portion and the bottom portion side first connection portion rotate separately without conjunction with each other, it is easier for the finger of the user to be pulled by these members which rotate separately.

[Aspect 10]

The cleaning tool according to aspect 8 or 9, wherein the top portion side first connection portion and the bottom portion side first connection portion are connected to the second arm portion, and the second connection portion is connected to the first arm portion.

In the above-mentioned cleaning tool, the top portion side first connection portion and the bottom portion side first connection portion are connected to the second arm portion, and the second connection portion is connected to the first arm portion, whereby the top portion side grip portion of the top portion side first connection portion and the bottom portion side grip portion of the bottom portion side first connection portion rotate together with the second arm portion. Accordingly, in a case in which the user rotates the second arm portion while retaining the rotation portion to the rotatable state by the hand holding the second arm portion, the top portion side grip portion and the bottom portion side grip portion rotate together with the second arm portion, and it is difficult for the hand holding the second arm portion to receive the friction by the top portion side grip portion and the bottom portion side grip portion.

To be specific, when the user, for example, in a state of attaching the fingertip of the right thumb to the top portion of the pushing portion and the top portion side grip portion, attaching the right index finger to the bottom portion side grip portion, and holding the second arm portion with the remaining portions of the right hand, while pushing the top portion of the pushing portion with the fingertip of the right thumb, pushing the pushing portion, and switching the rotation portion from the unrotatable state to the rotatable state, rotates the second arm portion, the top portion side grip portion and the bottom portion side grip portion rotate together with the second arm portion, and with the right hand, whereby it is difficult for the right thumb and index finger to receive the friction by the top portion side grip portion and the bottom portion side grip portion.

[Aspect 11]

The cleaning tool according to any one of aspects 8 to 10, wherein the rotation portion does not include, in the depth direction, a member which is not pushed together with the pushing portion in a region with a depth which is deeper than a depth of the bottom portion.

In the above-mentioned cleaning tool, the rotation portion does not include, in the depth direction, a member which is not pushed together with the pushing portion, for example, a lid portion, in a region with a depth which is deeper than a depth of the bottom portion, whereby the structure of the rotation portion is simple, and the above-mentioned cleaning tool is excellent from the viewpoint of manufacturing, etc. Further, although the above-mentioned cleaning tool does not include a member which is not pushed together with the pushing portion in a region with a depth which is deeper than a depth of the bottom portion, it is possible to operate the pushing portion as if pushing the same.

[Aspect 12]

The cleaning tool according to any one of aspects 8 to 11, wherein an inner diameter in the direction orthogonal to the rotation axis line of the bottom portion side grip portion is 20 mm or smaller in any direction.

In the above-mentioned cleaning tool, the bottom portion side grip portion has the predetermined inner diameter, whereby even in a case in which women, or children with small hands, etc. (hereinbelow, which may be referred to as "women, etc.") hold the rotation portion with the fingertip of a thumb, the fingertip of an index finger, etc., it is difficult for the finger of women, etc., to come into contact with the bottom portion of the pushing portion, especially, the bottom portion of the pushing portion at the initial depth position or the switch depth position, and thus it is easier for the user to operate the pushing portion as if pushing the same.

[Aspect 13]

The cleaning tool according to any one of aspects 8 to 12, wherein the top portion includes a peripheral portion which is arranged at a periphery of the top portion, and a protruded portion which is surrounded by the peripheral portion and is protruded from the peripheral portion toward an opposite direction of the bottom portion, and the top portion side grip portion is configured so as to be arranged, in the depth direction, at a depth position which is deeper than a depth position of the protruded portion of the pushing portion at the initial depth position.

In the above-mentioned cleaning tool, the top portion side grip portion is configured so as to be arranged, in the depth direction, at a depth position which is deeper than a depth position of the protruded portion of the pushing portion at the initial depth position, whereby it is easier for the user to push the protruded portion of the pushing portion.

[Aspect 14]

The cleaning tool according to aspect 13, wherein the top portion side grip portion is configured so as to be arranged, in the depth direction, at a depth position which is the same as a depth position of the peripheral portion of the pushing portion at the initial depth position, or at a depth position which is shallower than the depth position of the peripheral portion.

In the above-mentioned cleaning tool, the top portion side grip portion is configured so as to be arranged, in the depth direction, at a depth position which is the same as a depth position of the peripheral portion of the top portion of the pushing portion at the initial depth position, or at a depth position which is shallower than the depth position of the peripheral portion, whereby when the user pushes the top portion of the pushing portion, it is difficult for the finger of the user to get caught between the top portion side grip portion and the pushing portion.

Hereinbelow, the cleaning tool of the present disclosure is explained in detail.

Figure 12:
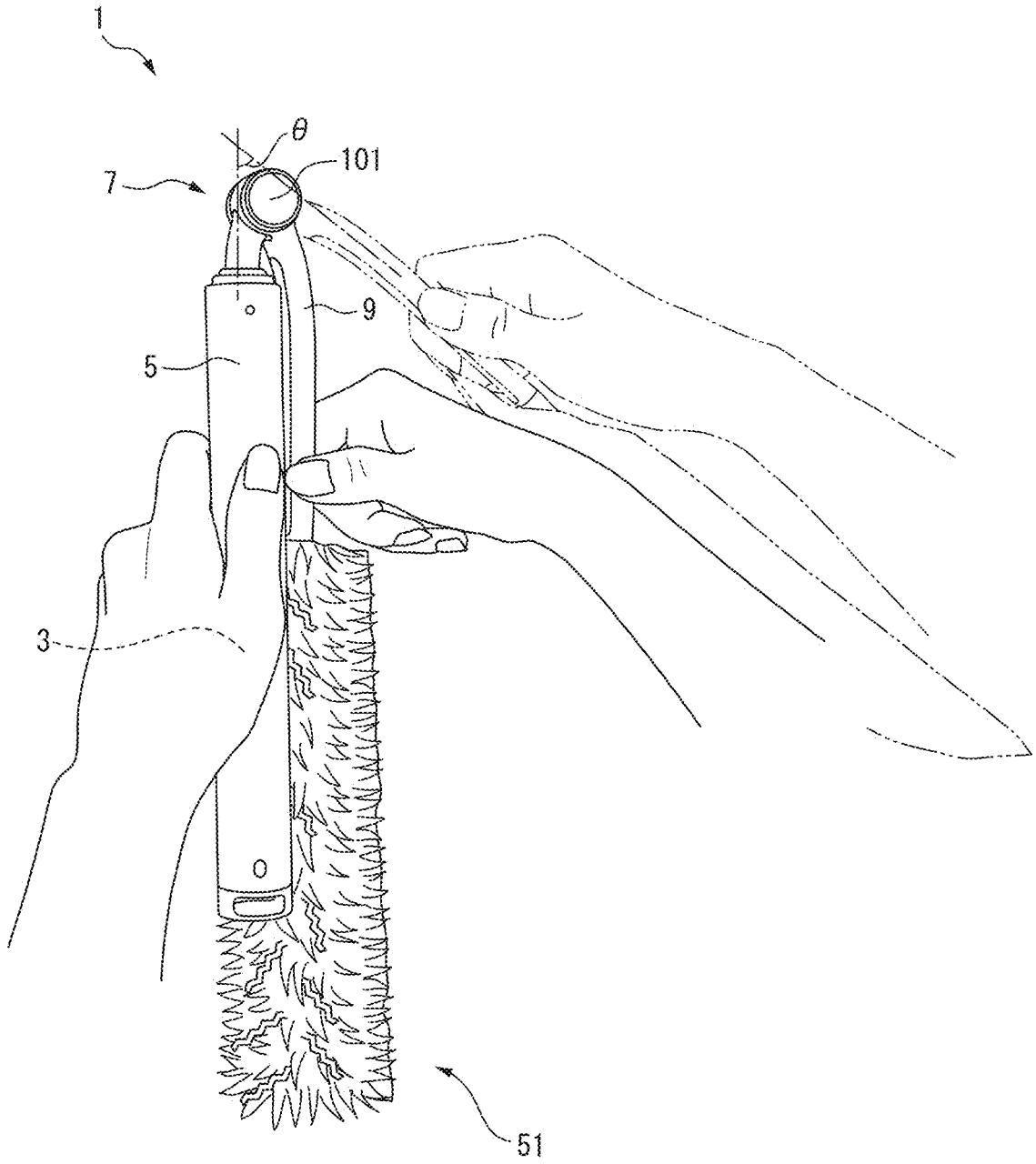
FIG. 12 is a view so as to explain the procedure of deforming the cleaning tool 1 from the stored state to the cleaning state.
Figure 13:
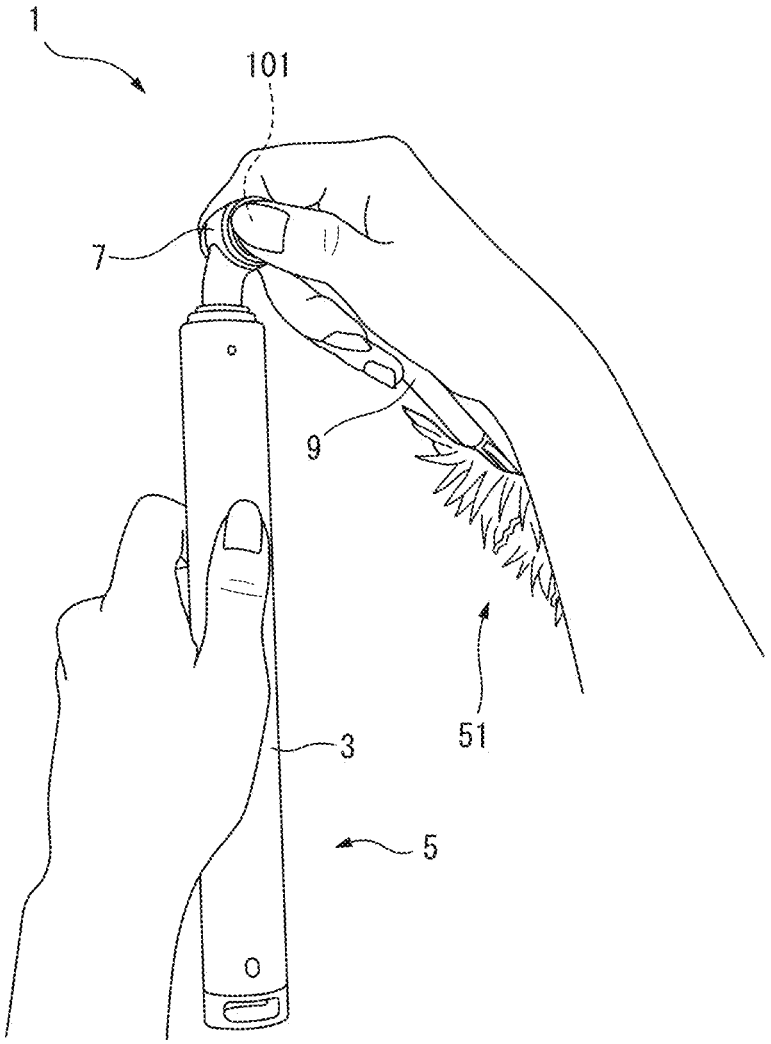
FIG. 13 is another view so as to explain the procedure of deforming the cleaning tool 1 from the stored state to the cleaning state.

FIG. 1 to FIG. 11 are views so as to explain the cleaning tool 1 according to one embodiment of the present disclosure (hereinbelow, which is referred to as "the first embodiment"). FIG. 12 and FIG. 13 are views so as to explain the using method of the cleaning tool 1 according to the first embodiment.

FIG. 1 is a side surface view of the cleaning tool 1 in the stored state (the shrunk state). The cleaning tool 1 according to the first embodiment includes the first arm portion 5 which includes the grip portion 3, the second arm portion 9, the rotation portion 7 which connects the first arm portion 5 and the second arm portion 9 and can adjust the arm angle θ, and the cleaning body attachment portion 11 which is connected to the second arm portion 9 for attaching a cleaning body (which is not shown). The cleaning tool 1 includes the base end 15 which is present at the farthest position from the rotation portion 7 of the first arm portion 5, and the tip end 13 which is present at the farthest position from the rotation portion 7 of the cleaning body attachment portion 11.

Incidentally, since the cleaning body attachment portion has the known structure which is the same as that described in Japanese Unexamined Patent Publication No. 2014-168646, the explanation thereof is omitted.

As shown in FIG. 1, the cleaning tool 1 can change the arm angle θ from 0° to 270° with an interval of 45°.

Figure 2:
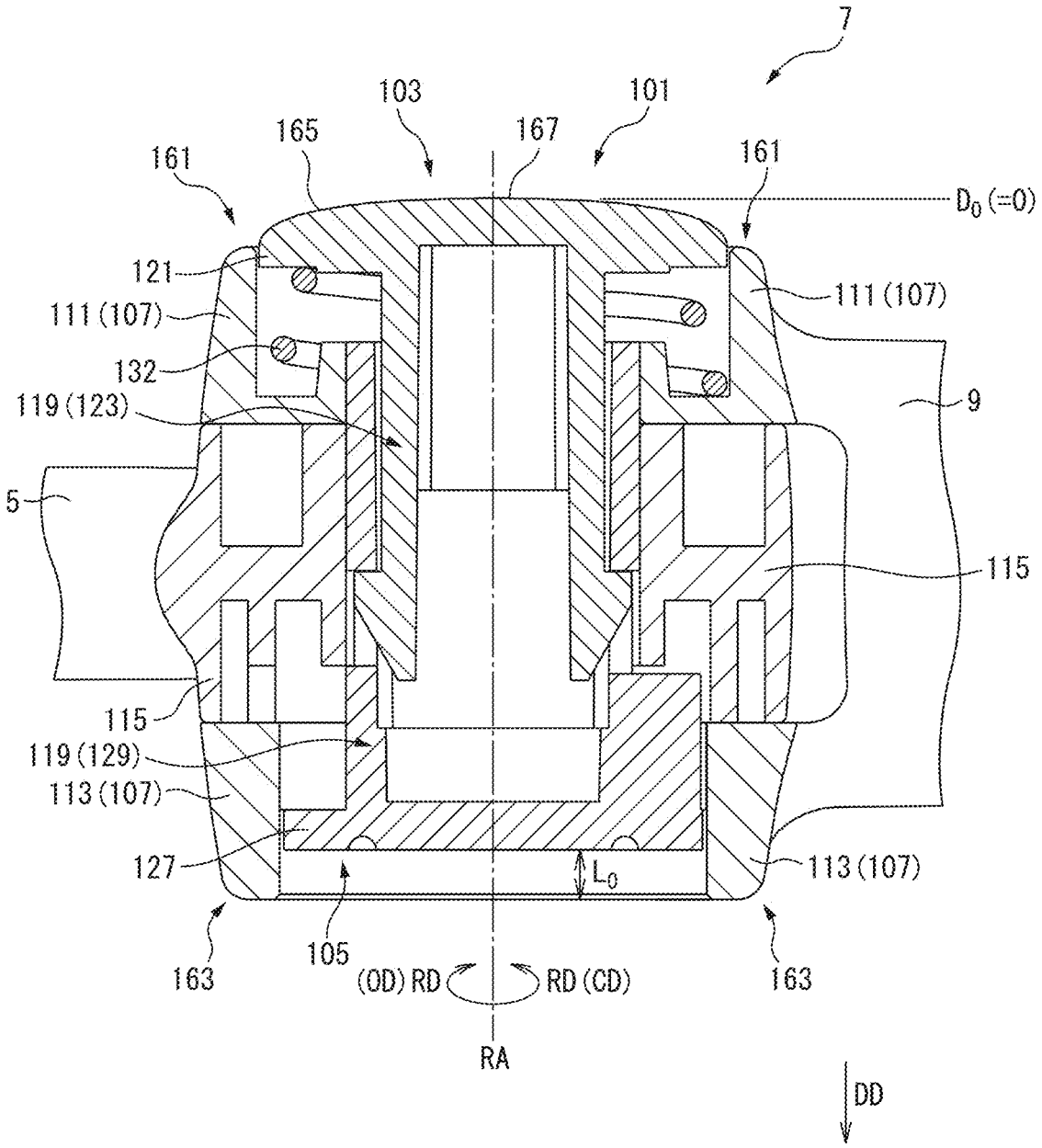
FIG. 2 is a cross sectional view of the rotation portion 7 in which the pushing portion 101 is arranged at the initial depth position: $D_0$, in the II-II cross section of FIG. 1.
Figure 3:
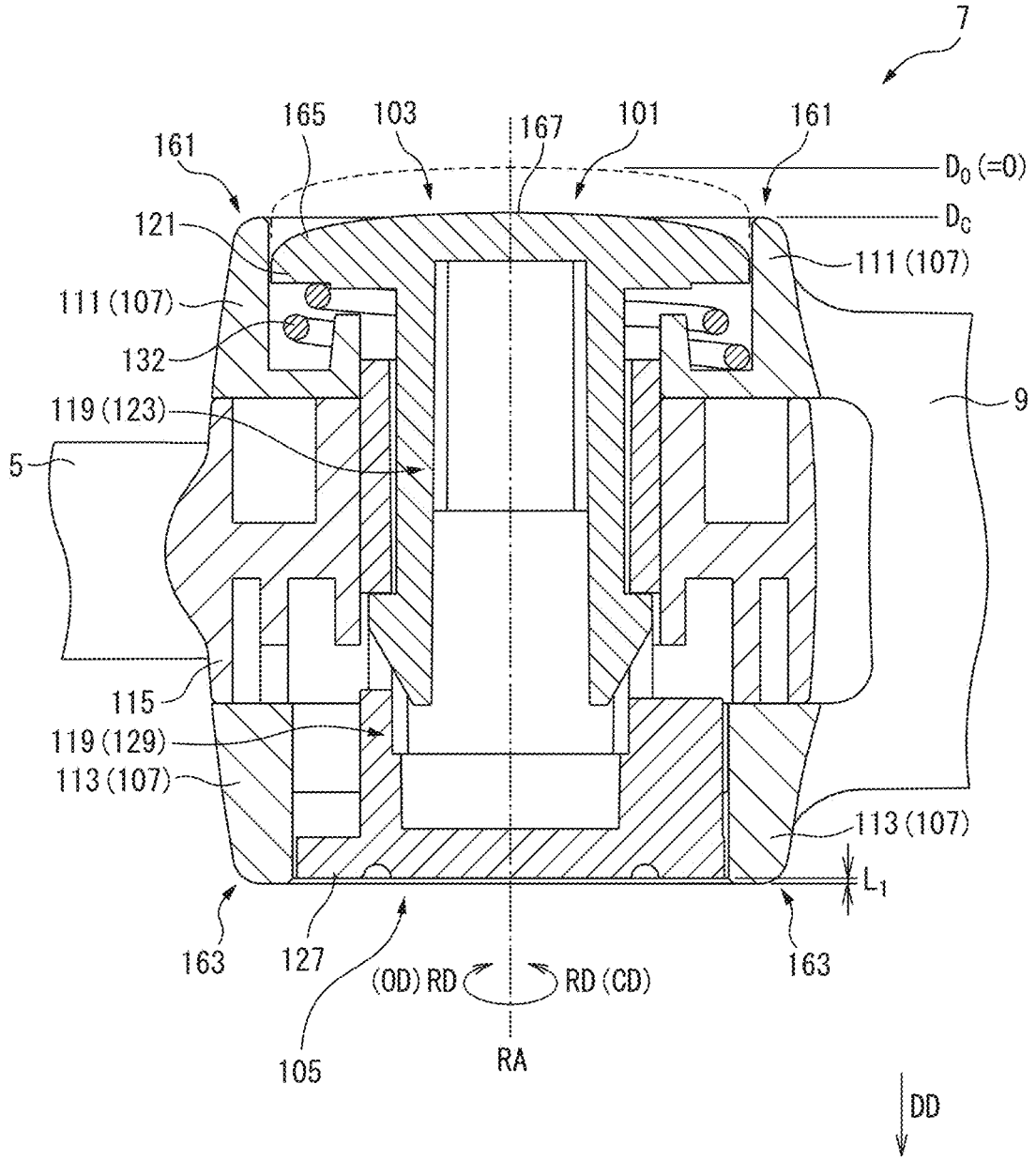
FIG. 3 is a cross sectional view of the rotation portion 7 in which the pushing portion 101 is pushed to the switch depth position: $D_C$, which corresponds to the II-II cross section of FIG. 1.
Figure 4A:
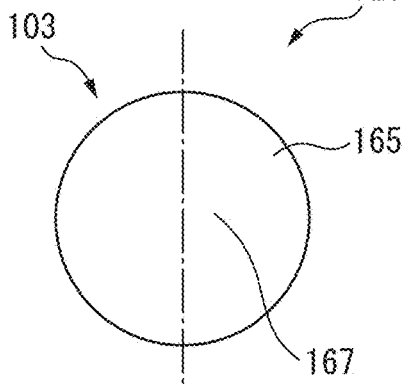
FIGS. 4A to 4D are views so as to explain the top portion side part 121 which configures the pushing portion 101.
Figure 4B:
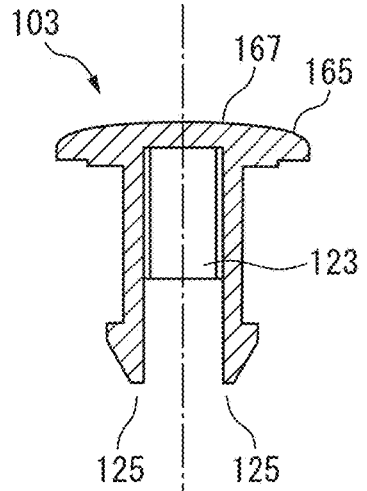
Figure 4D:
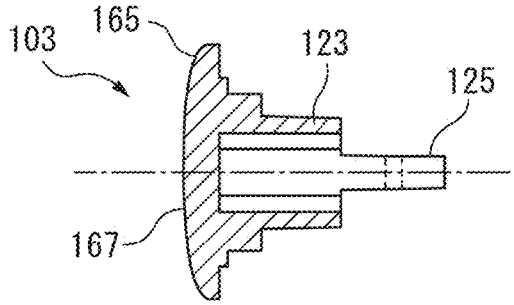
Figure 4C:
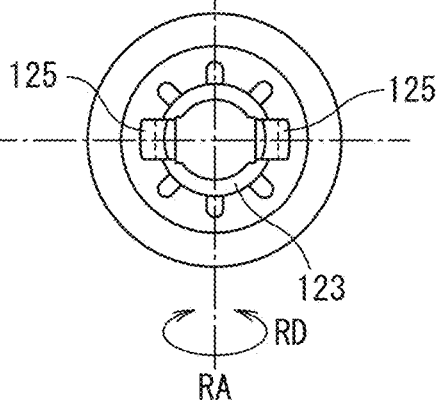

FIG. 2 to FIG. 11 are views so as to explain the rotation portion 7. To be specific, FIG. 2 is a cross sectional view of the rotation portion 7 in which the pushing portion 101 is arranged at the initial depth position: $D_0$, in the II-II cross section of FIG. 1. FIG. 3 is a cross sectional view of the rotation portion 7 in which the pushing portion 101 is pushed to the switch depth position: $D_C$, which corresponds to the II-II cross section of FIG. 1.

FIGS. 4A to 4D are views so as to explain the top portion side part 121 which configures the pushing portion 101. To be specific, FIG. 4A to FIG. 4D are a plan view [FIG. 4A], a cross sectional view of the front surface [FIG. 4B], a bottom surface view [FIG. 4C], and a cross sectional view of the left side surface [FIG. 4D], respectively, in a case in which the top portion side part 121 is viewed from the same direction as the viewing direction of the II-II cross section of FIG. 1.

Figure 5A:
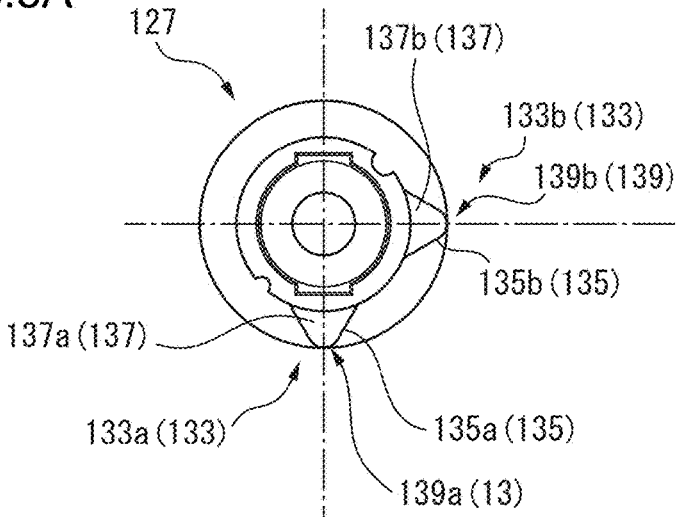
FIGS. 5A to 5E are views so as to explain the bottom portion side part 127 which configures the pushing portion 101.
Figure 5D:
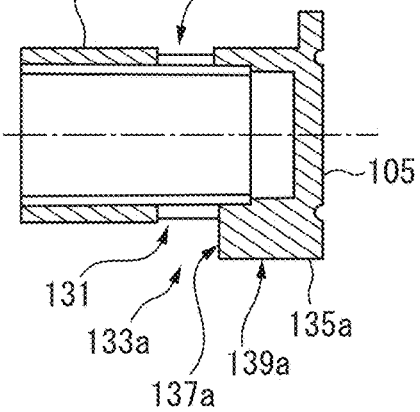
Figure 5B:
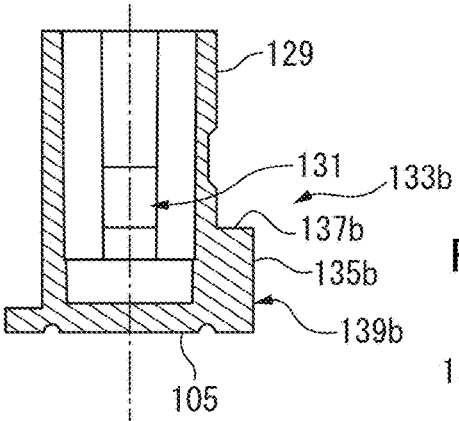
Figure 5E:
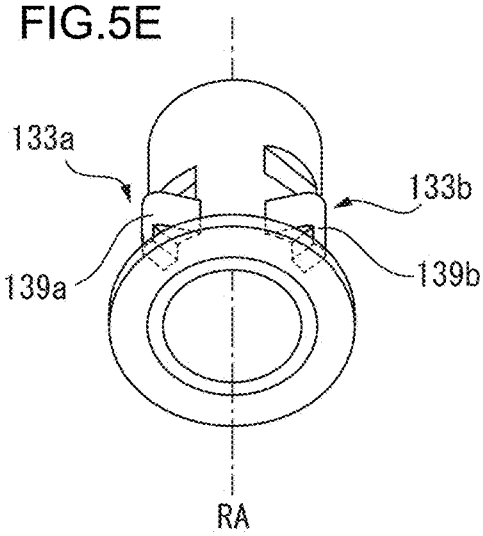
Figure 5C:
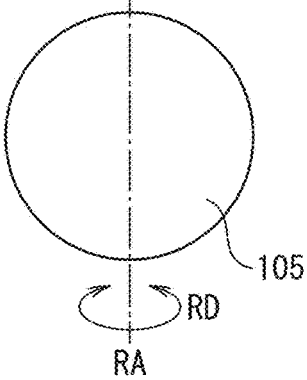

FIGS. 5A to 5E are views so as to explain the bottom portion side part 127 which configures the pushing portion 101. To be specific, FIG. 5A to FIG. 5D are a plan view [FIG. 5A], a cross sectional view of the front surface [FIG. 5B], a bottom surface view [FIG. 5C], and a cross sectional view of the right side surface [FIG. 5D], respectively, in a case in which the bottom portion side part 127 is viewed from the same direction as the viewing direction of the II-II cross section of FIG. 1. Further, FIG. 5E is a perspective view of the bottom portion side part 127.

Figure 6A:
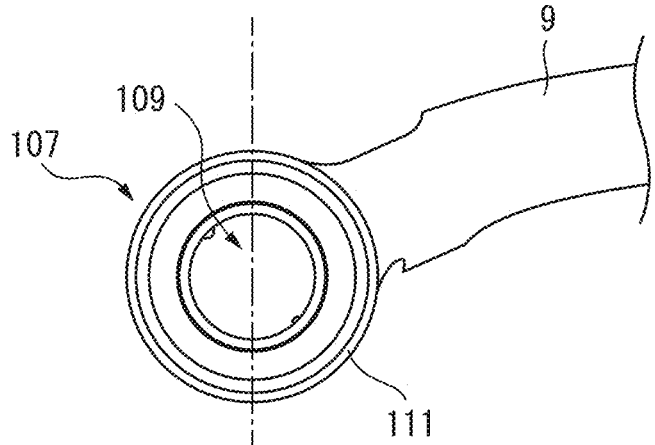
FIGS. 6A to 6C are views so as to explain the first connection portion 107.
Figure 6B:
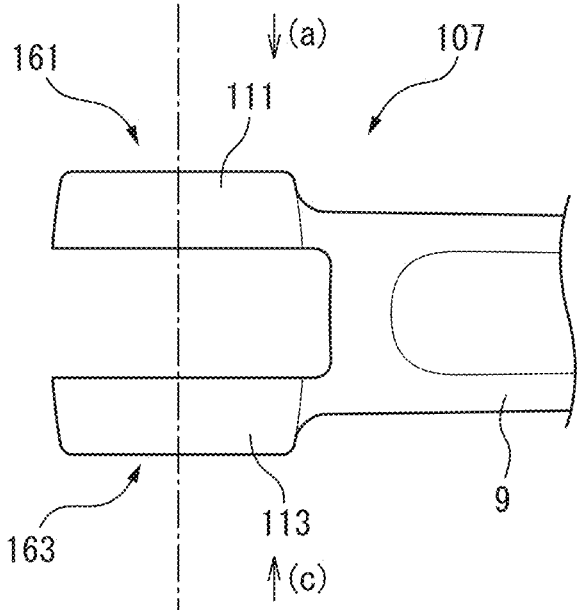
Figure 6C:
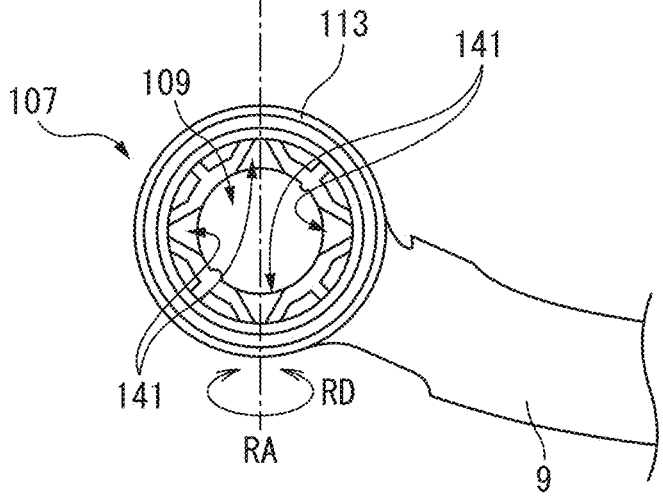

FIGS. 6A to 6C are views so as to explain the first connection portion 107. To be specific, FIG. 6A to FIG. 6C are a plan view [FIG. 6A], a front surface view [FIG. 6B], and a bottom surface view [FIG. 6C], respectively, in a case in which the first connection portion 107 is viewed from the same direction as the viewing direction of the II-II cross section of FIG. 1.

Figure 7A:
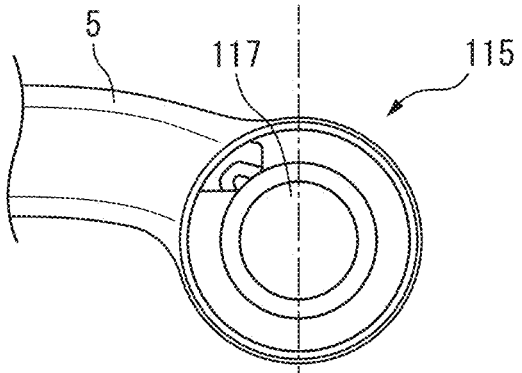
FIGS. 7A to 7D are views so as to explain the second connection portion 115.
Figure 7B:
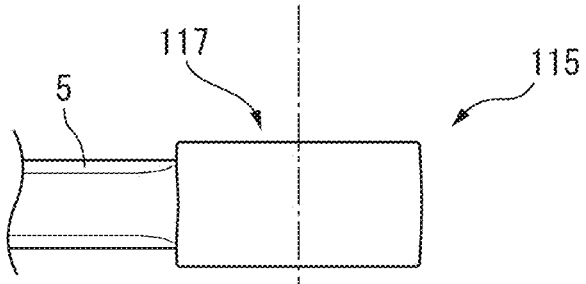
Figure 7C:
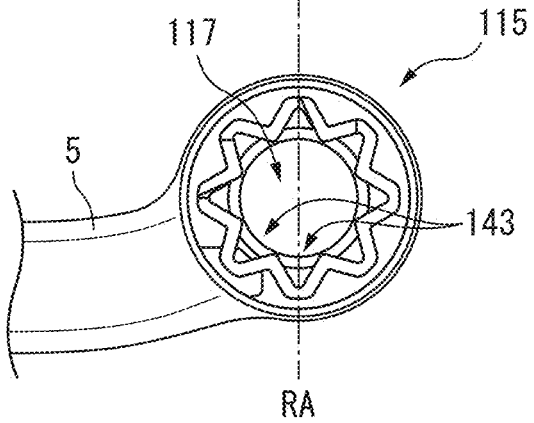
Figure 7D:
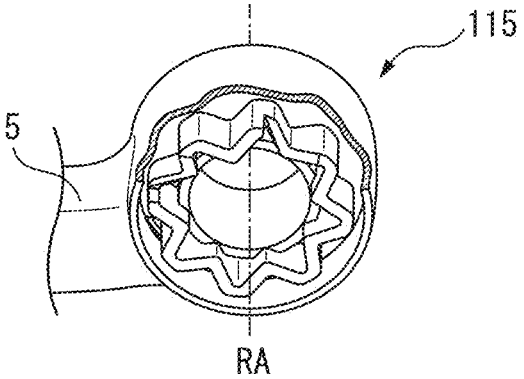
Figure 8:
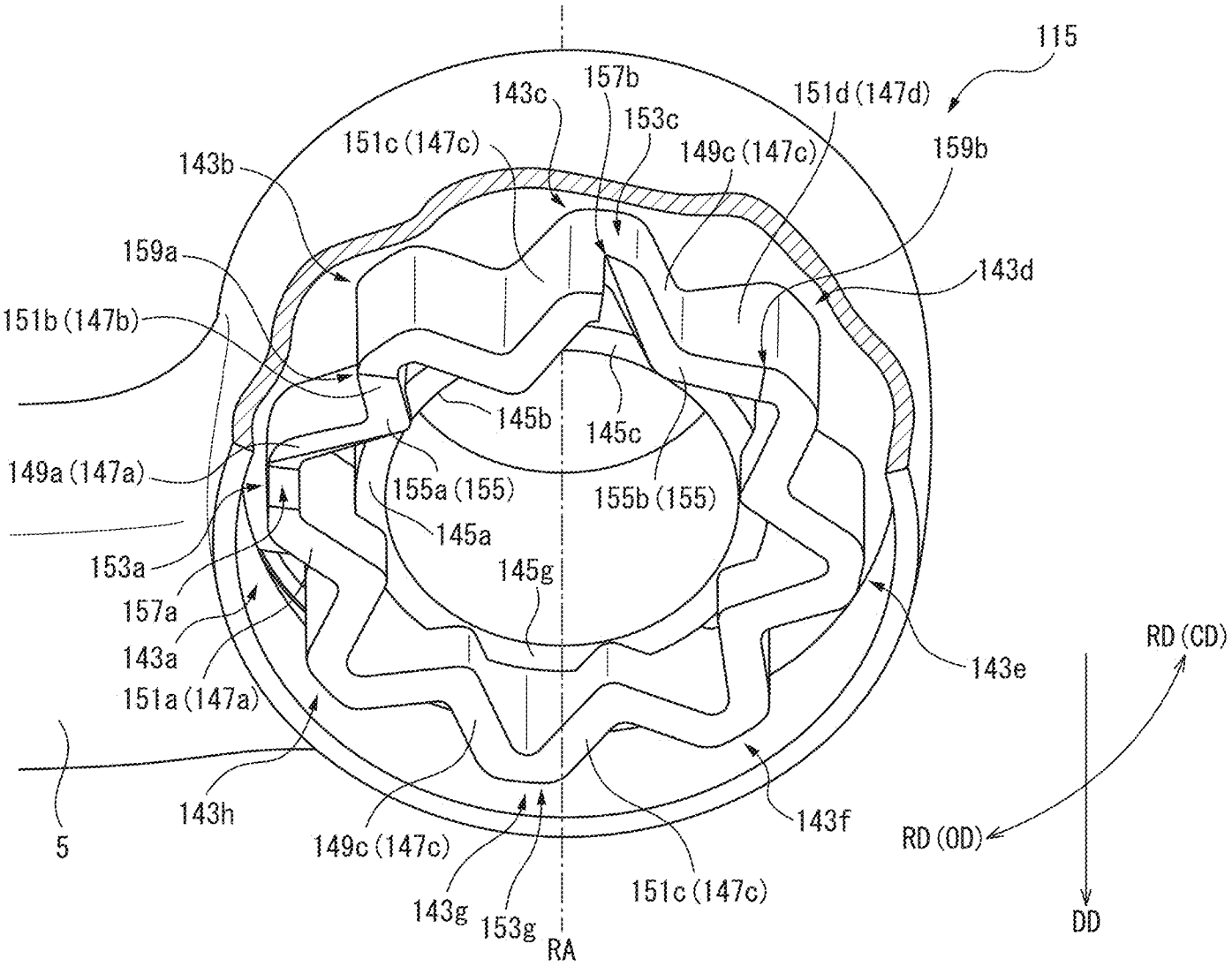
FIG. 8 is another view so as to explain the second connection portion 115.

FIGS. 7A to 7D and FIG. 8 are views so as to explain the second connection portion 115. To be specific, FIG. 7A to FIG. 7C are a front surface view [FIG. 7A], a cross sectional view [FIG. 7B], and a bottom surface view [FIG. 7C], respectively, in a case in which the second connection portion 115 is viewed from the same direction as the viewing direction of the II-II cross section of FIG. 1. Further, FIG. 7D is a perspective view of the second connection portion 115. FIG. 8 is an enlarged view of FIG. 7D in which the top and the bottom are reversed, that is, is a view in which the second connection portion 115 is observed from the lower side in the depth direction DD.

Figure 9:
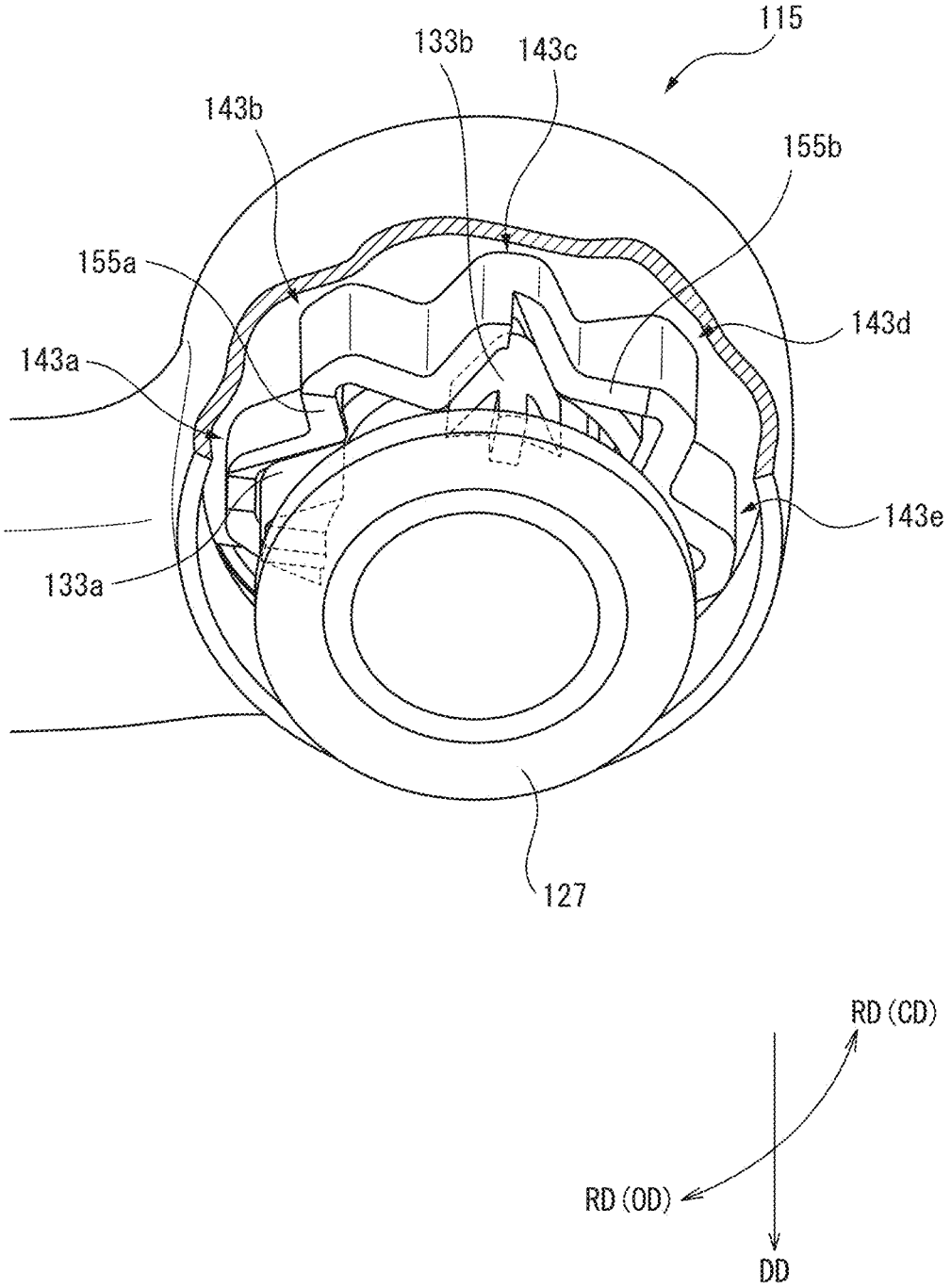
FIG. 9 is a view so as to explain the relationship between the bottom portion side part 127 of the pushing portion 101 and the second connection portion 115 when changing the arm angle from 0° to 45°.
Figure 10:
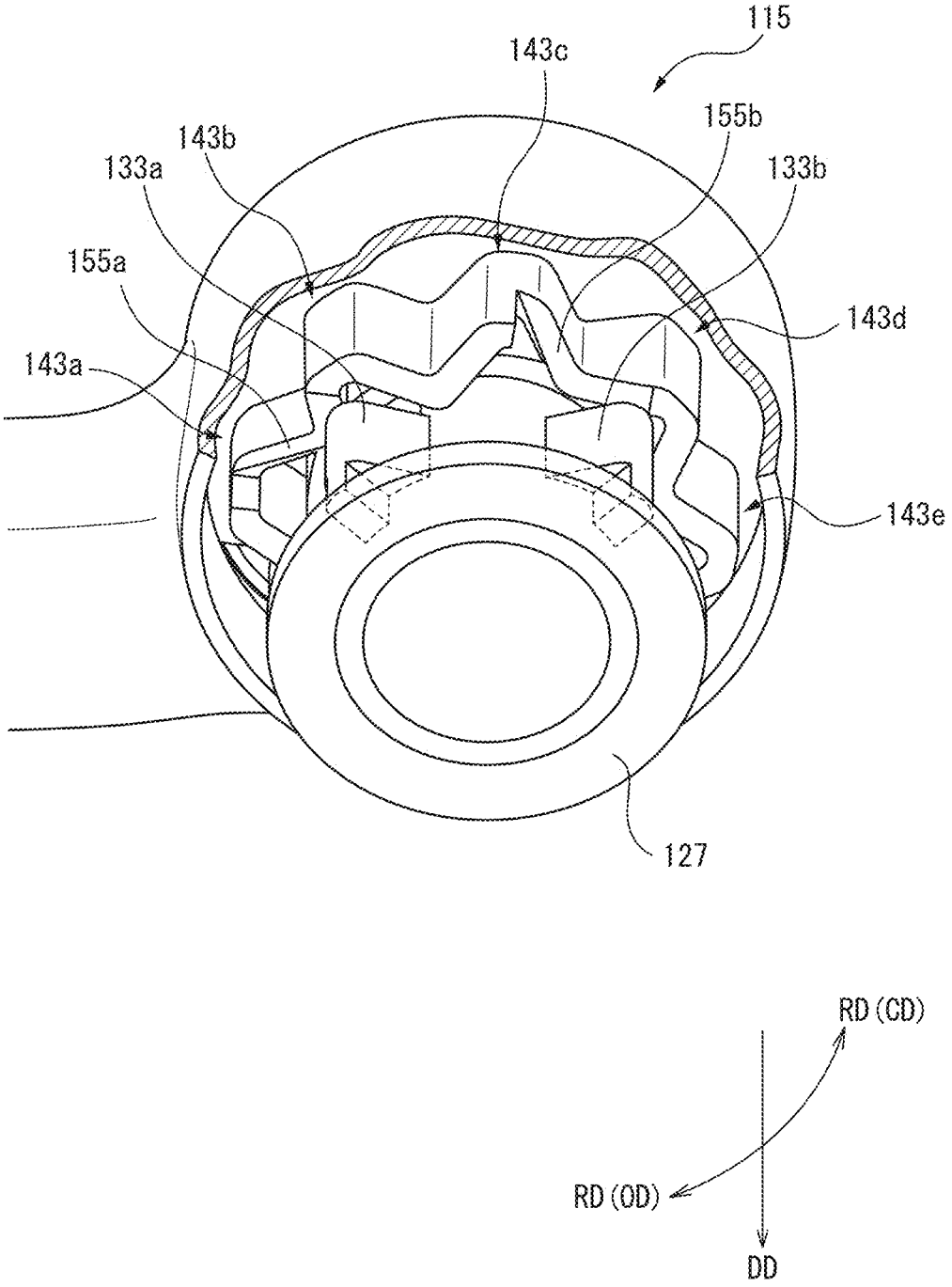
FIG. 10 is another view so as to explain the relationship between the bottom portion side part 127 of the pushing portion 101 and the second connection portion 115 when changing the arm angle from 0° to 45°.
Figure 11:
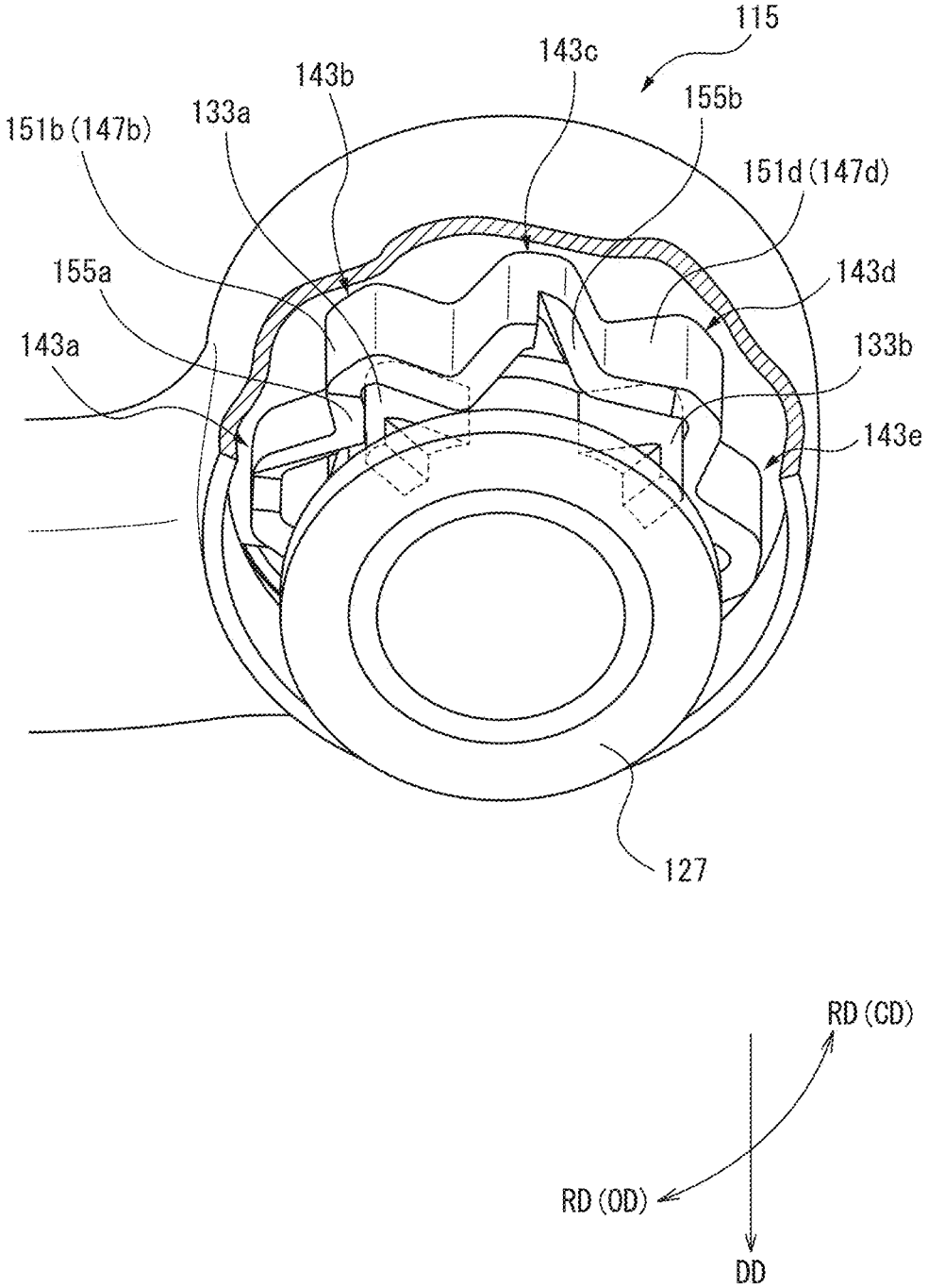
FIG. 11 is still another view so as to explain the relationship between the bottom portion side part 127 of the pushing portion 101 and the second connection portion 115 when changing the arm angle from 0° to 45°.

FIG. 9 to FIG. 11 are views so as to explain the relationship between the bottom portion side part 127 of the pushing portion 101 and the second connection portion 115 when changing the arm angle from 0° to 45°.

FIG. 12 and FIG. 13 are views so as to explain the procedure of deforming the cleaning tool 1 from the stored state to the cleaning state.

The rotation portion 7 connects the first arm portion 5 and the second arm portion 9, and can change the arm angle θ. The rotation portion 7 includes the rotation axis line RA, the rotation direction RD which rotates along the rotation axis line RA, and the depth direction DD along the direction in which the rotation axis line RA extends. Incidentally, the depth direction DD is the direction in which the pushing portion 101 is pushed. Further, the rotation direction RD is partitioned into the opening direction OD and the closing direction CD. The rotation portion 7 includes the pushing portion 101 which includes the top portion 103 and the bottom portion 105, the two first connection portions 107 which are connected to the second arm portion 9, each of which including the first shaft hole 109, and the second connection portion 115 which is connected to the first arm portion 5 and includes the second shaft hole 117. Each of the first shaft hole 109 and the second shaft hole 117 has a cross sectional shape in the direction orthogonal to the rotation axis line RA that is a circle in which the center is present on the rotation axis line RA.

The two first connection portions 107 are configured by the top portion side first connection portion 111 which is arranged at the shallowest depth position, and the bottom portion side first connection portion 113 which is arranged at the deepest depth position, among the two first connection portions 107 and the second connection portion 115.

The pushing portion 101 includes, in addition to the top portion 103 and the bottom portion 105, the connection shaft 119 which connects the top portion 103 and the bottom portion 105.

The pushing portion 101 is formed by the top portion side part 121 which includes the top portion 103, the top portion side cylindrical portion 123 and the protrusion for fitting 125, and the bottom portion side part 127 which includes the bottom portion 105, the bottom portion side cylindrical portion 129 and the hollow for fitting 131.

The rotation portion 7 is formed by making the top portion side cylindrical portion 123 of the top portion side part 121 from the top portion 103 side, and the bottom portion side cylindrical portion 129 of the bottom portion side part 127 from the bottom portion 105 side, pass through the first shaft hole 109 of the bottom portion side first connection portion 113, the second shaft hole 117 of the second connection portion 115, the first shaft hole 109 of the top portion side first connection portion 111, and the hollow portion of the compression coil spring 132, and making the pair of protrusions for fitting 125 of the top portion side part 121 fit with the pair of hollows for fitting 131 of the bottom portion side part 127. The connection shaft 119 of the pushing portion 101 is configured by the top portion side cylindrical portion 123 of the top portion side part 121 and the bottom portion side cylindrical portion 129 of the bottom portion side part 127.

FIG. 2 shows the rotation portion 7 in which the pushing portion 101 is not pushed, that is, in which the pushing portion 101 is arranged at the initial depth position: $D_0$. FIG. 3 shows the rotation portion 7 in which the pushing portion 101 is pushed to the switch depth position: $D_C$.

The pushing portion 101 which is arranged at the initial depth position: $D_0$ as shown in FIG. 2 forms the pushing portion 101 which is pushed up to the switch depth position: $D_C$ as shown in FIG. 3, when the user pushes the top portion 103 of the pushing portion 101 up to the switch depth position: $D_C$, and the pushing portion 101 which is pushed up to the switch depth position: $D_C$ as shown in FIG. 3 returns to the pushing portion 101 at the initial depth position: $D_0$ by the restoring force of the compression coil spring 132, when the user releases the pushing of the top portion 103 of the pushing portion 101.

The pushing portion 101 includes the two protrusions for rotation control 133 (the protrusion for rotation control 133*a* and the protrusion for rotation control 133*b*) on the outer peripheral surface of the connection shaft 119. The two protrusions for rotation control 133 are members which fix the arm angle θ of the first arm portion 5 and the second arm portion 9 by fitting with the later described eight hollows for rotation control 143. The two protrusions for rotation control 133 (the protrusion for rotation control 133*a* and the protrusion for rotation control 133*b*) include the side surface portion 135 (the side surface portion 135*a* and the side surface portion 135*b*), and the sliding portions 137 (the sliding portion 137*a* and the sliding portion 137*b*) which are arranged at the end portions on the deeper side in the depth direction DD. Further, the side surface portions 135 (the side surface portion 135*a* and the side surface portion 135*b*) include the distal portion 139*s* (the distal portion 139*a* and the distal portion 139*b*) which are present at the farthest positions from the rotation axis line RA.

To be specific, the protrusion for rotation control 133*a* includes the side surface portion 135*a* which protrudes in the direction orthogonal to the rotation axis line RA and extends in the direction of the rotation axis line RA, and the sliding portion 137*a* which is arranged at the end portion on the deeper side in the depth direction DD (the end portion on the bottom portion 105 side of the pushing portion 101). The side surface portion 135*a* includes the distal portion 139*a* which is present at the farthest position from the rotation axis line RA.

Further, the protrusion for rotation control 133*b* includes the side surface portion 135*b* which protrudes in the direction orthogonal to the rotation axis line RA and extends in the direction of the rotation axis line RA, and the sliding portion 137*b* which is arranged at the end portion on the deeper side in the depth direction DD (the end portion on the bottom portion 105 side of the pushing portion 101). The side surface portion 135*b* includes the distal portion 139*b* which is present at the farthest position from the rotation axis line RA.

The protrusion for rotation control 133*a* and the protrusion for rotation control 133*b* are arranged in the rotation direction RD with an interval of 90°. Each of the protrusion for rotation control 133*a* and the protrusion for rotation control 133*b* has an outer surface cross sectional shape in the direction orthogonal to the rotation axis line RA that is substantially triangle in which the vertexes point outward of the rotation axis line RA.

As shown in FIGS. 5A to 5E, each of the protrusion for rotation control 133*a* and the protrusion for rotation control 133*b* is formed at the outer peripheral surface of the bottom portion side cylindrical portion 129 of the bottom portion side part 127 which configures the pushing portion 101.

As shown in FIGS. 6A to 6C, the bottom portion side first connection portion 113 includes the hollow for fixing 141 which engages with the protrusions for rotation control 133 (the protrusion for rotation control 133*a* and the protrusion for rotation control 133*b*) of the pushing portion 101, on the outer peripheral of the first shaft hole 109. In the first embodiment, the total of four hollows for fixing 141 are present, and each of the total of four hollows for fixing 141 is arranged in the rotation direction RD with an interval of 90°. Each of the total of four hollows for fixing 141 has an inner surface cross sectional shape in the direction orthogonal to the rotation axis line RA that is substantially triangle in which the vertexes point outward of the rotation axis line RA, and is substantially the same as the outer surface cross sectional shape of the substantial triangle of each of the two protrusions for rotation control 133.

Incidentally, the first connection portions 107 (the top portion side first connection portion 111 and the bottom portion side first connection portion 113) are members which rotate in the rotation direction RD together with the pushing portion 101 (the protrusions for rotation control 133), whereby two hollows for fixing 141 have only to be present at positions which correspond to the protrusions for rotation control 133 (the protrusion for rotation control 133*a* and the protrusion for rotation control 133*b*).

As shown in FIGS. 6A to 6C, the top portion side first connection portion 111 does not include the hollow for fixing in the first shaft hole 109.

As shown in FIGS. 7A to 7D and FIG. 8, the second connection portion 115 includes the eight hollows for rotation control 143 on the outer peripheral of the second shaft hole 117 with an interval of 45°. Each of the eight hollows for rotation control 143 includes the base portion 145 which is configured so as to receive the sliding portion 137 of the protrusions for rotation control 133, and the wall portion for rotation control 147 which fixes the arm angle by fitting with the side surface portion 135 of the protrusions for rotation control 133. Incidentally, the base portion 145 is positioned on the inner side than the wall portion for rotation control 147. Further, the second connection portion includes the predetermined opening direction inclination portion 155.

Incidentally, the inner surface cross sectional shape in the direction orthogonal to the rotation axis line RA of each of the total of eight wall portion for rotation control 147 which are present in the eight hollows for rotation control 143, respectively, is substantially triangle in which the vertexes point outward of the rotation axis line RA, and is substantially the same as cross sectional shape of the substantial triangle of each of the protrusions for rotation control 133.

To be specific, the eight hollows for rotation control 143, in the cleaning tool 1 in the stored state, from the one fitting with the protrusion for rotation control 133*a*, are referred to as the first the hollow for rotation control 143*a*, the second the hollow for rotation control 143*b*, the third hollow for rotation control 143*c*, (omitted), and the eighth hollow for rotation control 143*h*, in order in the opening direction OD. Incidentally, the first the hollow for rotation control 143*a* to the eighth hollow for rotation control 143*h* may be referred to as the $n^{th}$ hollow for rotation control 143*n* (n=a to h). The same applies to the other members.

The $n^{th}$ hollow for rotation control 143*n* (n=a to h) includes the $n^{th}$ base portion 145*n* (n=a to h) which is configured so as to receive the sliding portion 137 (the sliding portion 137*a* and the sliding portion 137*b*) of the protrusions for rotation control 133 (the protrusion for rotation control 133*a* and the protrusion for rotation control 133*b*), and the $n^{th}$ wall portion for rotation control 147*n* (n=a to h) which fixes the arm angle θ by fitting with the side surface portions 135 (the side surface portion 135*a* and the side surface portion 135*b*) of the protrusions for rotation control 133 (the protrusion for rotation control 133*a* and the protrusion for rotation control 133*b*).

Further, the $n^{th}$ wall portion for rotation control 147*n* (n=a to h) includes the $n^{th}$ distal corresponding portion 153*n* (n=a to h) which corresponds to the distal portions 139 (the distal portion 139*a* and the distal portion 139*b*) of the protrusions for rotation control 133 (the protrusion for rotation control 133*a* and the protrusion for rotation control 133*b*), and which is the farthest from the rotation axis line RA.

Still further, the $n^{th}$ wall portion for rotation control 147*n* (n=a to h) is partitioned into the $n^{th}$ opening direction wall portion 149*n* (n=a to h) which is present in the opening direction OD and the $n^{th}$ closing direction wall portion 151*n* (n=a to h) which is present in the closing direction CD, with the $n^{th}$ distal corresponding portion 153*n* (n=a to h) as a boundary.

Incidentally, FIG. 8 shows only a portion among the $n^{th}$ base portion 145*n* (n=a to h), the $n^{th}$ wall portion for rotation control 147*n* (n=a to h), the $n^{th}$ opening direction wall portion 149*n* (n=a to h), and the $n^{th}$ opening direction wall portion 149*n* (n=a to h).

At the end portion on the opening direction OD side of the first the hollow for rotation control 143*a* (the end portion on the second hollow for rotation control 143*b* side), the depth position of the first wall portion for rotation control 147*a* in the depth direction DD is substantially the same as the depth position of the first base portion 145*a* in the depth direction DD.

Further, at the end portion on the opening direction OD side of the third hollow for rotation control 143*c* (the end portion on the fourth hollow for rotation control 143*d* side), the depth position of the third wall portion for rotation control 147*c* in the depth direction DD is substantially the same as the depth position of the third base portion 145*c* in the depth direction DD.

The second connection portion 115, in the cleaning tool 1 in the stored state, includes the opening direction inclination portion 155*a* which has the point that crosses with the first distal corresponding portion 153*a* of the first wall portion for rotation control 147*a* of the first hollow for rotation control 143*a* as the starting point 157*a*, and the ending point 159*a* at the second wall portion for rotation control 147*b* of the second hollow for rotation control 143*b*. In other words, the opening direction inclination portion 155*a* is present over the first opening direction wall portion 149*a* of the first hollow for rotation control 143*a* and the second closing direction wall portion 151*b* of the second hollow for rotation control 143*b*.

The first base portion 145*a*, the second base portion 145*b*, and the starting point 157*a* have substantially the same depth position in the depth direction DD.

In the same manner, the second connection portion 115, in the cleaning tool 1 in the stored state, includes the opening direction inclination portion 155*b* which has the point that crosses with the third distal corresponding portion 153*c* of the third wall portion for rotation control 147*c* of the third hollow for rotation control 143*c* as the starting point 157*b*, and the ending point 159*b* at the fourth wall portion for rotation control 147*d* of the fourth hollow for rotation control 143*d*. In other words, the opening direction inclination portion 155*b* is present over the third opening direction wall portion 149*c* of the third hollow for rotation control 143*c* and the fourth closing direction wall portion 151*d* of the fourth hollow for rotation control 143*d*.

The first base portion 145*a*, the second base portion 145*b*, and the starting point 157*a* have substantially the same depth position in the depth direction DD.

As shown in FIG. 9, in the cleaning tool 1 in the stored state, the protrusion for rotation control 133*a* and the protrusion for rotation control 133*b* fit with the first hollow for rotation control 143*a* and the third hollow for rotation control 143*c*, respectively. Subsequently, when the user increases the arm angle θ from 0° so as to deform the cleaning tool 1 from the stored state to the cleaning state as shown in FIG. 12, without pushing the pushing portion (refer to FIG. 2, etc.), as shown in FIG. 10, the protrusion for rotation control 133*a* and the protrusion for rotation control 133*b* slide on the opening direction inclination portion 155*a* and the opening direction inclination portion 155*b*, respectively, and start moving toward the directions of the second hollow for rotation control 143*b* and the fourth hollow for rotation control 143*d*, respectively, and further, the pushing portion (refer to FIG. 2, etc.) is pushed toward the switch depth position.

Subsequently, when the protrusion for rotation control 133*a* and the protrusion for rotation control 133*b* which slide on the opening direction inclination portion 155*a* and the opening direction inclination portion 155*b* finish the sliding of the opening direction inclination portion 155*a* and the opening direction inclination portion 155*b*, respectively, so as to exceed the second closing direction wall portion 151*b* and the fourth closing direction wall portion 151*d*, as shown in FIG. 11, the protrusion for rotation control 133*a* and the protrusion for rotation control 133*b* move the second hollow for rotation control 143*b* and the fourth hollow for rotation control 143*d* respectively to a shallow position in the depth direction DD until they come into contact with the second base portion 145*b* and the fourth base portion 145*d*, and fit with the second hollow for rotation control 143*b* and the fourth hollow for rotation control 143*d*, and further, the pushing portion (refer to FIG. 2, etc.) returns to the initial depth position. As a result, the cleaning tool 1 with the arm angle of 45° can no longer increase or decrease the arm angle θ unless the pushing portion (refer to FIG. 2, etc.) is pushed.

When the protrusion for rotation control 133*a* and the protrusion for rotation control 133*b* come into contact with the second base portion 145*b* and the fourth base portion 145*d*, respectively, the same makes a contact sound, or the pushing portion (refer to FIG. 2, etc.) moves back and forth from the switch depth position to the initial depth position, whereby the user can intuitively understand that he needs to push the pushing portion (refer to FIG. 2, etc.) in order to change the arm angle θ.

By pushing the pushing portion 101, the cleaning tool 1 can increase the arm angle θ to an arm angle θ of greater than 45°. Hereinbelow, the method of changing the arm angle θ by pushing the pushing portion 101 is explained.

Incidentally, the cleaning tool 1 can also change the arm angle θ from 0° to 45° by pushing the pushing portion 101.

As shown in FIG. 2, in a case in which the pushing portion 101 is arranged at the initial depth position: $D_0$, the protrusions for rotation control 133 (the protrusion for rotation control 133*a* and the protrusion for rotation control 133*b*) of the pushing portion 101 engage with the hollow for fixing 141 of the bottom portion side first connection portion 113, and the protrusions for rotation control 133 of the pushing portion 101 engage with two of the eight hollows for rotation control 143 of the second connection portion 115, whereby the arm angle θ cannot be changed.

On the other hand, when the pushing portion 101 is pushed in the depth direction DD up to the switch depth position: $D_C$, as shown in FIG. 3, the protrusions for rotation control 133 (the protrusion for rotation control 133*a* and the protrusion for rotation control 133*b*) of the pushing portion 101 are also pushed in the depth direction DD, and the protrusions for rotation control 133 (the protrusion for rotation control 133*a* and the protrusion for rotation control 133*b*) of the pushing portion 101 are no longer engaged with the hollows for rotation control 143 (the $n^{th}$ hollow for rotation control 143*n*) of the second connection portion 115, however, is to be in a state of being engaged with the hollow for fixing 141 of the bottom portion side first connection portion 113. As a result, the second arm portion 9 which is connected to the pushing portion 101 through the first connection portion 107 (the top portion side first connection portion 111 and the bottom portion side first connection portion 113) cannot rotate with respect to the pushing portion 101, however, is to be able to rotate with respect to the first arm portion 5 which is connected to the pushing portion 101 through the second connection portion 115 and the pushing portion 101, whereby it becomes possible to change the arm angle θ.

Incidentally, the pushing portion 101 can be pushed in the depth direction DD beyond the switch depth position: $D_C$, up to the maximum depth position (which is not shown).

The pushing portion 101 is engaged with the hollow for fixing 141 of the bottom portion side first connection portion 113 even when being pushed to the switch depth position: $D_C$ or the maximum depth position (which is not shown), whereby in a case in which the arm angle θ is changed, the pushing portion 101 is to rotate together with the second arm portion 9.

When the user finishes changing the arm angle θ, and releases the pushing of the top portion 103 of the pushing portion 101, by the action of the compression coil spring 132, the pushing portion 101 returns to the initial depth position: $D_0$, and at this time, the protrusions for rotation control 133 (the protrusion for rotation control 133*a* and the protrusion for rotation control 133*b*) of the pushing portion 101 engage with the hollow for fixing 141 of the bottom portion side first connection portion 113, and the protrusions for rotation control 133 (the protrusion for rotation control 133*a* and the protrusion for rotation control 133*b*) of the pushing portion 101 engage with the hollows for rotation control 143 (the $n^{th}$ hollow for rotation control 143*n*) different from the ones before the rotation among the eight hollows for rotation control 143 (the $n^{th}$ hollow for rotation control 143*n*) of the second connection portion 115, whereby the arm angle θ can no longer be changed.

The top portion side first connection portion 111 includes the top portion side grip portion 161 at the shallowest depth position thereof, which is a portion having a possibility that a user comes into contact when pushing the top portion 103 of the pushing portion 101. Further, the bottom portion side first connection portion 113 includes the bottom portion side grip portion 163 at the deepest depth position thereof, which is a portion having a possibility that a user comes into contact when pushing the pushing portion 101. Each of the top portion side grip portion 161 and the bottom portion side grip portion 163 goes around in the rotation direction RD.

As shown in FIG. 2, in the pushing portion 101 which is arranged at the initial depth position: $D_0$, the bottom portion 105 is configured so as to be arranged at the depth position in the depth direction DD, shallower than the bottom portion side grip portion 163 of the bottom portion side first connection portion 113, by the length: $L_0$ which is longer than the switch depth position: $D_C$ of the pushing portion 101. Accordingly, as shown in FIG. 3, when the pushing portion 101 is pushed up to the switch depth position: $D_C$, the bottom portion 105 is to be arranged at the depth position in the depth direction DD, shallower than the bottom portion side grip portion 163 of the bottom portion side first connection portion 113, by the length: $L_1$. Accordingly, the user can operate the pushing portion 101 as if pushing the same. Further, in a case in which the user pushes the top portion 103 of the pushing portion 101 up to the switch depth position: $D_C$ of the pushing portion 101, it is difficult for the finger which is attached to the bottom portion 105 side to be pushed out from the bottom portion 105.

Further, the rotation portion 7 does not include, in the depth direction DD, a configurational member which configures the rotation portion 7, especially, a member which is not pushed together with the pushing portion 101, in a region with a depth which is deeper than the bottom portion 105. Accordingly, although the structure of the rotation portion 7 is simple, the pushing portion 101 can be operated as if pushing the same.

The top portion 103 of the pushing portion 101 includes the peripheral portion 165 which is arranged at the periphery of the top portion 103, and the protruded portion 167 which is surrounded by the peripheral portion 165. In other words, the protruded portion 167 is arranged at a shallower depth position in the depth direction DD than the peripheral portion 165. Further, the top portion side grip portion 161 is arranged at a deeper depth position in the depth direction DD than the peripheral portion 165 of the pushing portion 101 which is arranged at the initial depth position: $D_0$, whereby the top portion side grip portion 161 is configured so as to be arranged at a deeper depth position in the depth direction DD than the position of the protruded portion 167 of the pushing portion 101 at the initial depth position: $D_0$. Accordingly, it is easier for the user to push the protruded portion 167 of the pushing portion 101 without receiving the influence of the top portion side grip portion 161. Further, when the user pushes the top portion 103 of the pushing portion 101, it is difficult for the finger of the user to get caught between the top portion side grip portion 161 and the peripheral portion 165 of the pushing portion 101.

As described above, the first connection portion 107 (the top portion side first connection portion 111 and the bottom portion side first connection portion 113) is connected to the second arm portion 9, and the second connection portion 115 is connected to the first arm portion 5. Accordingly, for example, when the user attaches the fingertip of the right thumb to the top portion 103 of the pushing portion 101 and the top portion side grip portion 161, attaches the right index finger to the bottom portion side grip portion 163, and holds the second arm portion 9 with the remaining portions of the right hand, the top portion 103 of the pushing portion 101, the top portion side grip portion 161 and the bottom portion side grip portion 163 rotate together with second arm portion 9, and with the right hand, whereby it is difficult for the right thumb and index finger to receive the friction by the top portion 103 of the pushing portion 101, the top portion side grip portion 161 and the bottom portion side grip portion 163.

The first arm portion 5 has an extendable and shrinkable property. The structure of the arm portion with the extendable and shrinkable property is known, and thus, the explanation is omitted in the present description.

With reference to FIG. 12 and FIG. 13, one example of the procedure of deforming the cleaning tool 1 according to the first embodiment from the stored state to the cleaning state is explained.

The cleaning tool 1 which is in the stored state, in which the cleaning body 51 is attached to the cleaning body attachment portion (which is not shown) is prepared.

As shown in FIG. 12, the user holds the grip portion 3 of the first arm portion 5 of the cleaning tool 1 with the left hand, holds the second arm portion 9 with the right hand, and for example, by pulling the right hand to the right, the arm angle θ can be easily changed from 0° to 45°.

Accordingly, for example, it is not necessary to take a painful posture in which the elbows of both arms approach, such that while the user attaching the fingertip of the right thumb to the top portion (refer to FIG. 2, etc.) of the pushing portion 101 and the top portion side grip portion (refer to FIG. 2, etc.), and attaching the right index finger to the bottom portion side grip portion (refer to FIG. 2, etc.) of the pushing portion 101 of the rotation portion 7, the user holds the second arm portion 9 with the remaining portions of the right hand.

Further, in a case in which it is the first time for the user to use the cleaning tool 1, the user may not understand the procedure of the deformation, however, even in such cases, when the user changes the arm angle θ from 0° to 45°, a contact sound occurs, or the pushing portion 101 moves back and forth from the switch depth position to the initial depth position, whereby the user can intuitively understand that he needs to push the pushing portion in order to change the arm angle θ.

Subsequently, as shown in FIG. 13, while attaching the fingertip of the right thumb to the top portion (refer to FIG. 2, etc.) of the pushing portion 101 and the top portion side grip portion (refer to FIG. 2, etc.), attaching the right index finger to the bottom portion side grip portion (refer to FIG. 2, etc.) of the pushing portion 101 of the rotation portion 7, and holding the second arm portion 9 with the remaining portions of the right hand, the user may push the top portion 103 of the pushing portion 101 with the fingertip of the right thumb, so as to switch the rotation portion 7 from the unrotatable state to the rotatable state, whereby can rotate the rotation portion 7 so that the arm angle θ has the desired angle.

Subsequently, the first arm portion 5 is made to shrink, and the cleaning tool 1 can be deformed to the cleaning state.

As described above, it is easy for the cleaning tool 1 according to the first embodiment to deform from the stored state to the cleaning state.

In the first embodiment, the rotation portion 7 includes, as the connection portion, the two first connection portions 107 (the top portion side first connection portion 111 and the bottom portion side first connection portion 113), and the second connection portion 115 which is present in between, however, in the rotation portion of the cleaning tool of the present disclosure, the number of the first connection portion and the second connection portion, and the positional relationship thereof are not particularly limited as long as the rotation portion includes two or more first connection portions (including the top portion side first connection portion and the bottom portion side first connection portion), and one or a plurality of second connection portions. For example, the rotation portion may include three first connection portions (including the top portion side first connection portion and the bottom portion side first connection portion) and two second connection portions, and the three first connection portions and the two second connection portions may be arranged alternately. Further, the rotation portion may include two first connection portions (the top portion side first connection portion and the bottom portion side first connection portion) and two second connection portions, and the two second connection portions which are apart from each other may be arranged between the two first connection portions.

In the first embodiment, the pushing portion 101 includes the two protrusions for rotation control 133 (the protrusion for rotation control 133*a* and the protrusion for rotation control 133*b*), however, in the cleaning tool of the present disclosure, the number of the protrusions for rotation control included in the pushing portion is not particularly limited. As the number of the protrusions for rotation control included in the pushing portion, for example, one, two, three, four, etc., may be mentioned. By increasing the number of the protrusions for rotation control included in the pushing portion, it becomes easier to control the rotation of the rotation portion.

In the cleaning tool of the present disclosure, it is preferable that the above-mentioned protrusion for rotation control is arranged on the outer peripheral surface of the connection shaft of the pushing portion.

In the cleaning tool of the present disclosure, it is preferable that the above-mentioned protrusion for rotation control includes the side surface portion which protrudes toward the direction orthogonal to the rotation axis line and extends in the direction of the rotation axis line, and the sliding portion which is arranged at the end portion on the deeper side in the depth direction, and the side surface portion includes the distal portion which is the farthest from the rotation axis line.

In the cleaning tool of the present disclosure, the outer surface cross sectional shape of the protrusion for rotation control in the direction orthogonal to the rotation axis line may include a dot-like distal portion, or a linear (for example, an arc) distal portion.

In the cleaning tool of the present disclosure, it is preferable that the outer surface cross sectional shape of the protrusion for rotation control in the direction orthogonal to the rotation axis line has a shape which comes closer to the connection shaft as moving away from the distal portion. Accordingly, it is easier for the sliding portion of the protrusion for rotation control to slide on the opening direction inclination portion of the second connection portion.

In the cleaning tool of the present disclosure, the second connection portion includes a plurality of hollows for rotation control. It is preferable that the plurality of hollows for rotation control are arranged along the second shaft hole of the second connection portion, and is more preferable that the same are arranged along the second shaft hole with the same interval (the same angle). Further, it is preferable that the plurality of hollows for rotation control are arranged on the bottom portion side of the pushing portion of the second connection portion.

Further, in the cleaning tool of the present disclosure, each of the plurality of hollows for rotation control includes the base portion which is configured so as to receive the sliding portion of the protrusion for rotation control, and the wall portion for rotation control which fixes the arm angle by fitting with the side surface portion of the protrusion for rotation control. It is preferable that the above-mentioned base portion is arranged at the depth position shallower in the depth direction than the above-mentioned wall portion for rotation control.

It is preferable that the above-mentioned wall portion for rotation control includes the distal corresponding portion which corresponds to the distal portion of the protrusion for rotation control.

It is preferable that the inner surface cross sectional shape of the above-mentioned wall portion for rotation control in the direction orthogonal to the rotation axis line corresponds to the outer surface cross sectional shape of the protrusion for rotation control in the direction orthogonal to the rotation axis line, is more preferable that they have the similar shape, and is even more preferable that they are substantially the same.

In the cleaning tool of the present disclosure, the second connection portion includes the opening direction inclination portion, in the first wall portion for rotation control of the first hollow for rotation control, which can move the protrusion for rotation control from the first hollow for rotation control to the second hollow for rotation control, by sliding the sliding portion of the protrusion for rotation control, without pushing the pushing portion.

Incidentally, in the present disclosure, the first hollow for rotation control means the hollow for rotation control which fits with the protrusion for rotation control in the cleaning tool in the stored state, and the second hollow for rotation control means the hollow for rotation control which is adjacent to the first hollow for rotation control in the opening direction.

Further, the first wall portion for rotation control and the second wall portion for rotation control mean the wall portions for rotation control included in the first hollow for rotation control and the second hollow for rotation control, respectively. Still further, the first distal corresponding portion and the second distal corresponding portion mean the distal corresponding portions included in the first wall portion for rotation control and the second wall portion for rotation control, respectively. The same applies to the other members.

Incidentally, in a case in which the cleaning tool of the present disclosure includes a plurality of protrusions for rotation control, the plurality of hollows for rotation control may include a plurality of first hollows for rotation control and a plurality of second hollows for rotation control.

In the cleaning tool of the present disclosure, the above-mentioned opening direction inclination portion is arranged at least in the first wall portion for rotation control, is preferably arranged at the first wall portion for rotation control and the second wall portion for rotation control, and is more preferably arranged between the first distal corresponding portion of the first wall portion for rotation control of the first hollow for rotation control and the second distal corresponding portion of the second wall portion for rotation control of the second hollow for rotation control. Further, it is preferable that the starting point of the above-mentioned opening direction inclination portion is present at the point which crosses with the first distal corresponding portion of the first wall portion for rotation control of the first hollow for rotation control, and that the ending point of the above-mentioned opening direction inclination portion is arranged at the second closing direction wall portion of the second wall portion for rotation control. Accordingly, it is easier for the user to change the arm angle smoothly in the cleaning tool in the stored state without pushing the pushing portion.

Incidentally, the ending point of the above-mentioned opening direction inclination portion may be present at the point which crosses with the second distal corresponding portion of the second wall portion for rotation control of the second hollow for rotation control.

In the cleaning tool of the present disclosure, in the first distal corresponding portion, it is preferable that the first wall portion for rotation control is arranged in the depth direction at the depth position which is the same as the depth position in the depth direction of the first base portion of the first hollow for rotation control, or at the depth position which is shallower than the same. Accordingly, it is easier for the user to change the arm angle smoothly in the cleaning tool in the stored state without pushing the pushing portion.

In the cleaning tool of the present disclosure, at the end portion on the opening direction side of the first hollow for rotation control (the end portion on the second hollow for rotation control side), it is preferable that the first wall portion for rotation control is arranged in the depth direction at the depth position which is the same as the depth position in the depth direction of the first base portion of the first hollow for rotation control, or at the depth position which is shallower than the same. Accordingly, it is easier for the user to change the arm angle smoothly in the cleaning tool in the stored state without pushing the pushing portion.

In a case in which the cleaning tool of the present disclosure includes a plurality of protrusions for rotation control, for example, in a case of including m number of protrusions for rotation control, it is preferable that the m number of protrusions for rotation control are not arranged with the interval (the angle) of (360/m°). For example, in a case in which the cleaning tool includes two protrusions for rotation control, it is preferable that the protrusions for rotation control are not arranged with the interval (the angle) of 180°. Accordingly, it becomes possible to change the arm angle for only the cleaning tool in the stored state, without pushing the pushing portion. In other words, it becomes difficult to change the arm angle in the cleaning state, in a case in which the cleaning tool comes into contact with the portion to be cleaned unexpectedly, etc.

In the cleaning tool of the present disclosure, in the plurality of hollows for rotation control, the opening direction inclination portion has only to be arranged at the first wall portion for rotation control, and the opening direction inclination portion may be arranged at any of the other wall portion for rotation controls.

In the cleaning tool of the present disclosure, the second wall portion for rotation control of the second hollow for rotation control may include the closing direction inclination portion which can move the protrusion for rotation control from the second hollow for rotation control to the first hollow for rotation control, by making the sliding portion of the protrusion for rotation control slide without pushing the pushing portion. Accordingly, the cleaning tool can be closed from the predetermined position (the position of the second hollow for rotation control) to the folded state and when the user folds the cleaning tool, it is not necessary to hold firmly the first arm portion and the second arm portion, and it is difficult to pinch a finger between the first arm portion and the second arm portion.

In the first embodiment, the bottom portion side grip portion 163 is configured so as to be arranged at the depth position in the depth direction DD, shallower than the bottom portion 105 of the pushing portion 101 which is arranged at the switch depth position: $D_C$, by the length: $L_1$, however, in the cleaning tool of the present disclosure, the bottom portion side grip portion may be configured so as to be arranged at the depth position in the depth direction which is the same as the depth position of the bottom portion of the pushing portion which is arranged at the switch depth position, or at the depth position which is deeper than the same. Accordingly, when the user pushes the pushing portion, and switches the rotation portion from the unrotatable state to the rotatable state, it is difficult for the bottom portion of the pushing portion to come into contact with the finger of the user, and the user can operate the pushing portion as if pushing the same.

In the cleaning tool of the present disclosure, in a case in which the pushing portion is pushed up to the maximum depth position, in the depth direction, the bottom portion of the pushing portion may be configured so as to arranged at the depth position which is deeper than the bottom portion side grip portion, by preferably less than 5%, more preferably less than 3%, even more preferably less than 2%, and still more preferably less than 1%, of the length in the rotation axis line direction of the pushing portion. This is because, in a case in which the pushing portion is pushed up to the maximum depth position, the user can operate the pushing portion as if pushing the same, even when the bottom portion of the pushing portion is protruded slightly more than the bottom portion side grip portion.

In the cleaning tool of the present disclosure, in a case in which the pushing portion is pushed up to the maximum depth position, in the depth direction, it is preferable that the bottom portion side grip portion is configured so as to be arranged at the depth position which is the same as the depth position of the bottom portion of the pushing portion, or at the depth position which is deeper than the same. This is from the viewpoint of it being difficult for the finger of the user to be pushed out from the bottom portion of the pushing portion, and being able to operate the pushing portion as if pushing the same.

Incidentally, in the depth direction, the depth position of the bottom portion of the pushing portion and the depth position of the bottom portion side grip portion are based on the deepest depth position thereof.

In the cleaning tool of the present disclosure, the structure of the rotation portion is not limited to the one of the first embodiment, as long as the rotation portion includes the pushing portion, and the unrotatable state and the rotatable state of the rotation portion can be switched by pushing the pushing portion.

In the cleaning tool of the present disclosure, when changing the above-mentioned arm angle, the pushing portion may be configured so as to rotate together with the top portion side first connection portion and the bottom portion side first connection portion, or to rotate together with the second connection portion, however, it is preferable that the same is configured so as to rotate together with the top portion side first connection portion and the bottom portion side first connection portion. This is because, when changing the arm angle, since the top portion side portion and the bottom portion side portion of the rotation portion of the pushing portion are to rotate in conjunction with each other, it is difficult for the finger of the user to be pulled in conjunction by a member which does not rotate.

In the first embodiment, two or more first connection portions are connected to the second arm portion and the second connection portion is connected to the first arm portion, however, in the cleaning tool of the present disclosure, the arm portion to which each of the two or more first connection portions and the second connection portion is connected is optional, and two or more first connection portions may be connected to the first arm portion, and the second connection portion may be connected to the second arm portion.

In a case in which two or more first connection portions are connected to the second arm portion, when the user for example attaches the fingertip of the right thumb to the top portion of the pushing portion, attaches the right index finger to the bottom portion side grip portion, and holds the second arm portion with the remaining portions of the right hand, the top portion side grip portion and the bottom portion side grip portion rotate together with the second arm portion, and with the right hand, whereby it is difficult for the right thumb and index finger to receive the friction by the top portion side grip portion and the bottom portion side grip portion.

In the cleaning tool of the present disclosure, it is preferable that the rotation portion does not include in the depth direction, a member which is not pushed together with the pushing portion in the region with the depth which is deeper than the bottom portion. This is because although the structure of the rotation portion is simple, it is possible to operate the pushing portion as if pushing the same.

In the cleaning tool of the present disclosure, the inner diameter of the bottom portion side grip portion in the direction orthogonal to the rotation axis line is, preferably 20 mm or smaller, more preferably 18 mm or smaller, and even more preferably 16 mm or smaller, in any direction. Accordingly, when the finger of the user holds the bottom portion side grip portion, it becomes difficult to enter the void which is surrounded by the bottom portion side grip portion, and it becomes difficult for the finger of the user to come into contact with the bottom portion of the pushing portion.

Further, in the cleaning tool of the present disclosure, the inner diameter of the bottom portion side grip portion in the direction orthogonal to the rotation axis line is, preferably 10 mm or greater, more preferably 12 mm or greater, and even more preferably 12 mm or greater, in any direction. This is from the viewpoint of it being easy for the top portion of the pushing portion to be pushed.

In the cleaning tool of the present disclosure, it is preferable that the top portion of the pushing portion includes the peripheral portion which is arranged at the periphery of the top portion, and the protruded portion which is surrounded by the peripheral portion and protrudes from the peripheral portion toward the opposite side of the bottom portion, and the top portion side grip portion is configured so as to be arranged at the depth position in the depth direction, which is deeper than the depth position of the protruded portion of the pushing portion which is arranged at the initial depth position. This is from the viewpoint of it being easy for the protruded portion of the pushing portion to be pushed.

It is preferable that the above-mentioned positional relationship is satisfied in a case in which the pushing portion is pushed up to the switch depth position, and it is more preferable that the same is satisfied in a case in which the pushing portion is pushed up to the maximum depth position. This is from the viewpoint of it being easy for the protruded portion of the pushing portion to be pushed.

In the cleaning tool of the present disclosure, in a case in which the top portion of the pushing portion includes the above-mentioned peripheral portion and the protruded portion, it is preferable that the top portion side grip portion of the pushing portion is configured so as to be arranged at the depth position in the depth direction, which is the same as the depth position of the peripheral portion of the pushing portion which is arranged at the initial depth position, or at the depth position which is shallower than the same. This is because when the user pushes the top portion of the pushing portion, it is difficult for the finger of the user to get caught between the top portion side grip portion and the pushing portion.

Incidentally, in the depth direction, the position of the peripheral portion and protruded portion of the top portion of the pushing portion and the position of the top portion side grip portion are based on the shallowest depth position thereof.

In the cleaning tool of the present disclosure, the first arm portion may be extendable and shrinkable in the axis line direction of the first arm portion, or may be unextendable and unshrinkable, however, it is preferable that the same is extendable and shrinkable in the axis line direction of the first arm portion. This is because, it becomes easier to rotate the rotation portion, and then, extend or shrink the first arm portion, or to extend or shrink the first arm portion, and then, rotate the rotation portion.

Further, the extendable and shrinkable first arm portion is not limited to the one described in the first embodiment, and the structure known in the technical field may be adopted.

In the cleaning tool of the present disclosure, the cleaning body attachment portion is not particularly limited, and the same may have a known structure, for example, the structure described in the above-mentioned publications.

In the cleaning tool of the present disclosure, the cleaning body may be any known cleaning body such as the disposable one, the one which is used repeatedly after washing, etc.

The invention claimed is:

1. A cleaning tool comprising a first arm portion, a second arm portion, a rotation portion, and a cleaning body attachment portion which is connected to the second arm portion, the cleaning tool being capable of taking a stored state, wherein the rotation portion includes a rotation axis line, a rotation direction which includes an opening direction, and a depth direction along the rotation axis line, the rotation portion further includes a pushing portion, two or more first connection portions which are connected to one of the first arm portion and the second arm portion, each of the first connection portions including a first shaft hole, and a second connection portion which is connected to the other of the first arm portion and the second arm portion and includes a second shaft hole, the pushing portion includes a protrusion for rotation control which fixes an arm angle of the first arm portion and the second arm portion, and penetrates the first shaft holes and the second shaft hole, the protrusion for rotation control includes a side surface portion which protrudes toward a direction orthogonal to the rotation axis line and extends in a direction of the rotation axis line, and a sliding portion which is arranged at an end portion on a deeper side in the depth direction, the second connection portion includes a plurality of hollows for rotation control which are arranged along the rotation direction, each of which including a base portion which is configured so as to receive the sliding portion of the protrusion for rotation control, and a wall portion for rotation control which fixes the arm angle by fitting with the side surface portion of the protrusion for rotation control, the rotation portion is configured so that a fitting of the side surface portion of the protrusion for rotation control and the wall portion for rotation control is released by pushing the pushing portion in the depth direction, and in the stored state, wherein the stored state is a state in which the arm angle is made to be a minimum, the second connection portion includes an opening direction inclination portion which makes the protrusion for rotation control move from a first hollow for rotation control which fits with the protrusion for rotation control among the plurality of hollows for rotation control to a second hollow for rotation control which is adjacent to the first hollow for rotation control in the opening direction, by making the sliding portion of the protrusion for rotation control slide, without pushing the pushing portion in a first wall portion for rotation control of the first hollow for rotation control.

2. The cleaning tool according to claim 1, wherein the opening direction inclination portion is arranged at least at an end portion on an opening direction side of the first hollow for rotation control, and the opening direction inclination portion at the end portion is arranged, in the depth direction, at a depth position which is the same as a depth position of a first base portion of the first hollow for rotation control, or at a depth position which is shallower than the depth position of the first base portion.

3. The cleaning tool according to claim 1, wherein the side surface portion of the protrusion for rotation control includes a distal portion which is farthest from the rotation axis line, the wall portion for rotation control includes a distal corresponding portion which corresponds to the distal portion, and the opening direction inclination portion is arranged between a first distal corresponding portion of the first wall portion for rotation control of the first hollow for rotation control and a second distal corresponding portion of a second wall portion for rotation control of the second hollow for rotation control.

4. The cleaning tool according to claim 3, wherein the opening direction inclination portion is arranged at the first distal corresponding portion, and the opening direction inclination portion at the first distal corresponding portion is arranged, in the depth direction, at a depth position which is the same as a depth position of a first base portion of the first hollow for rotation control, or at a depth position which is shallower than the depth position of the first base portion.

5. The cleaning tool according to claim 1, wherein the plurality of hollows for rotation control include five or more hollows for rotation control, and the plurality of hollows for rotation control are arranged with a predetermined interval along the rotation direction.

6. The cleaning tool according to claim 1, wherein a second wall portion for rotation control of the second hollow for rotation control includes a closing direction inclination portion which makes the protrusion for rotation control move from the second hollow for rotation control to the first hollow for rotation control, by making the sliding portion of the protrusion for rotation control slide, without pushing the pushing portion.

7. The cleaning tool according to claim 1, wherein the pushing portion further includes an additional protrusion for rotation control, such that the protrusion for rotation control and the additional protrusion for rotation control form a plurality of protrusions for rotation control, wherein a number of plurality of protrusions for rotation control is less than a number of plurality of hollows for rotation control.

8. The cleaning tool according to claim 1, wherein the pushing portion further includes, in the direction of the rotation axis line, a top portion, a bottom portion, and a connection shaft which connects the top portion and the bottom portion, and the pushing portion is pushed, in the depth direction, from an initial depth position up to a switch depth position, the two or more first connection portions further include a top portion side first connection portion which is arranged at a shallowest depth position and includes a top portion side grip portion, and a bottom portion side first connection portion which is arranged at a deepest depth position and includes a bottom portion side grip portion, and the bottom portion side grip portion is configured to be arranged, in the depth direction, at a depth position which is the same as a depth position of the bottom portion of the pushing portion which is arranged at the switch depth position, or at a depth position which is deeper than the depth position of the bottom portion.

9. The cleaning tool according to claim 8, wherein the pushing portion is configured so as to rotate together with the top portion side first connection portion and the bottom portion side first connection portion when changing the arm angle.

10. The cleaning tool according to claim 8, wherein the top portion side first connection portion and the bottom portion side first connection portion are connected to the second arm portion, and the second connection portion is connected to the first arm portion.

11. The cleaning tool according to claim 8, wherein the rotation portion does not include, in the depth direction, a member which is not pushed together with the pushing portion in a region with a depth which is deeper than a depth of the bottom portion.

12. The cleaning tool according to claim 8, wherein an inner diameter in the direction orthogonal to the rotation axis line of the bottom portion side grip portion is 20 mm or smaller in any direction.

13. The cleaning tool according to claim 8, wherein the top portion includes a peripheral portion which is arranged at a periphery of the top portion, and a protruded portion which is surrounded by the peripheral portion and is protruded from the peripheral portion toward an opposite direction of the bottom portion, and the top portion side grip portion is configured so as to be arranged, in the depth direction, at a depth position which is deeper than a depth position of the protruded portion of the pushing portion at the initial depth position.

14. The cleaning tool according to claim 13, wherein the top portion side grip portion is configured so as to be arranged, in the depth direction, at a depth position which is the same as a depth position of the peripheral portion of the pushing portion at the initial depth position, or at a depth position which is shallower than the depth position of the peripheral portion.

* * * * *